US010889406B2

(12) United States Patent
Oskarsson

(10) Patent No.: US 10,889,406 B2
(45) Date of Patent: Jan. 12, 2021

(54) SYSTEM OF OPEN-TOPPED CONTAINERS

(71) Applicant: SAEPLAST ICELAND EHF, Dalvik (IS)

(72) Inventor: Dagur Oskarsson, Dalvikurbyggd (IS)

(73) Assignee: SAEPLAST ICELAND EHF, Dalvik (IS)

( * ) Notice: Subject to any disclaimer, the term of this patent is extended or adjusted under 35 U.S.C. 154(b) by 0 days.

(21) Appl. No.: 15/571,433

(22) PCT Filed: May 4, 2016

(86) PCT No.: PCT/IS2016/050008
§ 371 (c)(1),
(2) Date: Nov. 2, 2017

(87) PCT Pub. No.: WO2016/178253
PCT Pub. Date: Nov. 10, 2016

(65) Prior Publication Data

US 2018/0127146 A1 May 10, 2018

(30) Foreign Application Priority Data

May 4, 2015 (IS) ..... 050105
Nov. 6, 2015 (IS) ..... 050127

(51) Int. Cl.
*B65D 19/04* (2006.01)
*B65D 21/02* (2006.01)
*B65D 81/26* (2006.01)

(52) U.S. Cl.
CPC ..... *B65D 19/04* (2013.01); *B65D 21/0212* (2013.01); *B65D 21/0215* (2013.01); *B65D 21/0234* (2013.01); *B65D 81/261* (2013.01)

(58) Field of Classification Search
CPC ..... B65D 21/0202; B65D 21/0212; B65D 81/261; B65D 25/2897; B65D 21/0233; B65D 21/0234; B65D 21/0222; B65D 21/0223
See application file for complete search history.

(56) References Cited

U.S. PATENT DOCUMENTS 2,325,281 A 7/1943 Schleicher
2,828,059 A 3/1958 Ross
3,049,265 A 8/1962 Van Moss, Jr.
3,424,334 A * 1/1969 Goltz ..... B65D 21/0202 220/23.6

(Continued)

FOREIGN PATENT DOCUMENTS

CN 202852157 U 4/2013
CN 202880138 U 4/2013

(Continued)

*Primary Examiner* — Andrew T Kirsch
(74) *Attorney, Agent, or Firm* — Heslin Rothenberg Farley & Mesiti P.C.; Stephen P. Scuderi

(57) ABSTRACT

The invention relates to a system of stackable open-top containers. The system comprises male and female containers that can be alternately stacked, either in upright or inverted position. When the system contains containers that are stacked in inverted position on top of upright container, substantial space saving is obtained by the system. The invention also provides male and female containers that are useful in the system of containers.

16 Claims, 22 Drawing Sheets

(56) References Cited

U.S. PATENT DOCUMENTS

| | | | | | |
|---|---|---|---|---|---|
| 3,623,631 | A | * | 11/1971 | Ford | B65D 19/08 206/503 |
| 3,993,211 | A | * | 11/1976 | Astle | B65D 19/18 220/1.5 |
| 4,267,700 | A | * | 5/1981 | Minter | A23B 4/023 62/70 |
| 4,478,156 | A | | 10/1984 | Andersson | |
| 4,660,724 | A | | 4/1987 | Gaynes | |
| 5,161,690 | A | * | 11/1992 | Foshaug | B65D 19/02 206/512 |
| 5,344,021 | A | * | 9/1994 | Rose | B65D 21/045 206/505 |
| 6,010,022 | A | * | 1/2000 | Deaton | B65D 19/18 220/4.03 |
| 6,142,300 | A | | 11/2000 | Kelly et al. | |
| 2010/0147727 | A1 | | 6/2010 | Valdimarsson et al. | |
| 2011/0139775 | A1 | | 6/2011 | Nolan | |
| 2012/0181214 | A1 | * | 7/2012 | Kernen | B65D 19/04 206/596 |

FOREIGN PATENT DOCUMENTS

| | | | |
|---|---|---|---|
| CN | 204489499 | U | 7/2015 |
| DE | 1906463 | U | 12/1964 |
| DE | 4033179 | A1 | 8/1991 |
| DE | 9102954 | U1 | 12/1991 |
| DE | 202005010181 | U1 | 10/2005 |
| FR | 1331138 | A | 6/1963 |
| GB | 1415068 | A | 11/1975 |
| GB | 2056262 | A | 3/1981 |
| GB | 2076366 | A | 12/1981 |
| NL | 7908488 | A | 6/1981 |
| NL | 9500345 | A | 10/1996 |
| WO | 9317923 | A1 | 9/1993 |
| WO | 0176959 | A2 | 10/2001 |
| WO | 2013002725 | A1 | 1/2013 |

* cited by examiner

SYSTEM OF OPEN-TOPPED CONTAINERS

CROSS REFERENCE TO RELATED APPLICATIONS

This application is a U.S. National Phase filing under 35 U.S.C. § 371 of International Application PCT/IS2016/050008, filed May 4, 2016, and published as WO 2016/178253 A1 on Nov. 10, 2016. PCT/IS2016/050008 claims priority from Icelandic application number 050105, filed May 4, 2015, and from Icelandic application number 050127, filed Nov. 6, 2015. The entire contents of each of these applications are hereby incorporated herein by reference.

BACKGROUND

The invention relates to stackable open top multi-purpose transport containers, especially containers for transporting food items.

Many containers used for the shipping of goods have the drawback that during transport, empty containers take up as much space as do filled ones. As a consequence, the cost of shipping empty containers, for example on sea vessels, is quite substantial. In general, it would be advantageous if empty containers could be stored in a manner that minimizes the amount of space they take up.

A further drawback of many containers is that when stacked, the stack of containers tends to be unstable, due to the slippage of the containers. This is a particular problem at sea, where movement caused by sea waves can easily cause stacks of containers to slip or collapse.

DE19704945 discloses a stacking crate that has a laying flange at the upper edge of the wall, with a counter flange at the lower edge. When crates are stacked, one crate rests on the upper flange of the lower crate through its lower flange structure.

DE4432030 discloses a container that has a sloping intermediate section in the centre of each side wall. Each side wall also has inward and outward projecting areas, that permit the stacking of containers. The front of the container has an opening, or it may be closed, having a sloping intermediate section in the front.

EP2024242 discloses a system of crates for transporting fish that have an edge are on their top that is in a channel shape, and has a through hole located on the outer side of the bottom of the crate wall adjacent to the edge are. The base of the crate has a second through hole, so that liquid can drain out from the crate into the channel-shaped are of a crate stacked below, and then through the first through-hole, out of the channel-shaped area alongside the outer side crate wall. The crates can be stacked on top of each other so that an upper crate can be inserted into a lower crate, and rotated about a vertical axis by 180°, and thus can empty boxes be stacked into one another.

BRIEF DESCRIPTION

The present invention provides containers that have the advantage that they can be stacked in multiple ways in both normal (upright) and inverted orientation. When empty and stacked, the containers can occupy significantly less space than they normally would, saving space during transport of empty containers. Further, when stacked, adjacent containers in a stack are interlocked so as to form a stable stack.

One aspect of the invention relates to an open top container (a male container) that comprises a bottom having an upper surface, a lower surface and an outer edge of each side thereof, the bottom interconnecting four side walls extending from the bottom, the side walls consisting of two pairs of oppositely located side walls extending from the bottom to form an opening having a rim around it, the lower end of the side walls being interconnected with the bottom at an inwardly position from the outer edge thereof, at least a portion of each of the side walls extending angularly inwardly from the bottom towards an opposing side wall. The container can further comprise at least one support member extending downwardly from the lower surface of the bottom in proximity to the outer edge of the bottom.

Preferably, the container has a continuous structure, meaning that the container is provided as a single continuous structural unit, and is not assembled from individual components.

The bottom of the male container can be rectangular, the four side walls being upright extending from the bottom. The lower end of the side wall can meet the bottom of the container at a distance from the edge of the bottom. This allows for another container with similar dimensions but with vertical side walls (a female container, as further described herein) to be placed in an inverted position on top the container. The distance from the edge of the bottom to the side walls of the container can preferably be such that a second (female) container, when placed on top of the container in an inverted position will fit snugly on top of the container, such that a sandwich-type structure of two containers is formed, in which the two containers are largely locked with respect to horizontal movement.

To facilitate the formation of sandwich-type structures, the side walls of the male container can preferably be tilted with respect to a vertical axis by an angle in a range from about 1° to about 10°, in a range from about 2° to about 8°, in range from about 3° to about 6°, or in a range from about 5°. The side walls of the male container can also be preferably tilted by an angle in a range from about 1° to about 5°. In other embodiments, the lower end of the tilt of the wall can be from about 1° to about 5°, or from about 2° to about 4°, or about 2°. The higher end of the tilt of the wall can be from about 4° to about 10°, or from about 5° to about 8°, or about 5°.

It is also possible that a portion of the side wall be tilted inwardly, i.e. towards an opposing wall, while the remaining portion of the wall is vertical. In such a configuration, an upper section of the wall is preferably tilted inwardly, while a lower section is substantially vertical. Further, the side wall can contain sections that are tilted to different degrees. For example a lower portion of the side wall can have a smaller tilt than an upper portion of the wall. The wall can also have a plurality of sections with varying tilt, for example a lower section that is vertical, a midsection that is tilted inwardly and an upper section that is vertical. Other configurations and shapes of the wall are also possible within the concept of the upper rim of the side wall being located closer to an opposing rim than the distance between the bottom of opposing walls. For example, the walls may have a concave or convex bend when viewed from the side, either along a portion of the wall or along the entire wall.

Two pairs of walls of the male container can have substantially identical configuration with respect to their tilt, even though their lengths are different. It is also possible that the two pairs of walls have different tilts, i.e. one pair of walls may be more or less tilted than the other pair of opposing walls. In one embodiment, all four walls of the male container are tilted to the same degree.

The support member of the container can be configured to allow for a fork lift to be inserted and lift the container. This is especially important for large and/or heavy containers, that cannot be easily lifted by manpower. It is preferable that the container thus configured contain at least one pair of oppositely positioned fork lift openings, that allow a fork to be inserted for transport/lifting of the container. The fork lift opening can also serve the purpose of allowing a crane or a specially configured fork lift to lift and rotate the container. The support member can be provided with at least two pairs of fork lift insertion openings, wherein each member of a pair of such openings is arranged opposite to a substantially identical opening. In other words, when viewing the container from one side, two fork lift insertion openings are seen on that side of the container, each arranged on a support member (that can either be a single support member having two fork lift insertion openings), and on the opposite side of the container, identical fork lift insertion openings are provided, preferably on identical support members, such that a fork lift can insert a fork through the fork lift openings and transport the container.

The skilled person will appreciate that other configurations of fork lift insertion openings are possible, for example by providing additional fork lift insertion openings that are adapted for use by different types of fork lifts that can have multiple prongs.

In one configuration, the support member is structured such that its outer edge is positioned inwardly from the outer edge of the bottom of the container. When provided as two oppositely positioned support members, the outer edge of the two support members can be positioned inwardly from the outer edge of the bottom of the container. The distance from the outer edge of the support members to the outer edge of the bottom can be about equal to the width of the upper rim of the container. When the support member is provided as a structure with irregular shape, the distance from the outermost edge to the outer edge of the bottom can suitably be about equal to the width of the upper rim of the side wall of the container.

In one configuration, the at least one support member is comprised of two pairs of oppositely located support members that are arranged close to two opposite outer edges of the bottom, such that each support member that is arranged close to a first outer edge of the bottom is oppositely located to a substantially identical support member that is arranged close to a second outer edge of the bottom.

The fork lift insertion openings can be provided as slits within the support member, of dimensions that are suitable for the insertion of a fork. The slits can have a height in the range of about 60 mm to about 100 mm, such as about 60 mm to about 80 mm, about 60 mm to about 70 mm, or about 70 mm to about 90 mm. It can be convenient to have the slits configured to be of a height that is about the same, or slightly greater than, the thickness of a typical lift fork. In some embodiments, the slits have a height of about 66 mm. The width of the slits can range from about 150 mm to about 400 mm, such as about 200 mm to about 300 mm, or about 250 mm to about 300 mm. The support member can be a continuous structure, at least along, or in close proximity to, the outer edge of the bottom of the container, extending downwards from the bottom, the structure having fork lift insertion openings provided as slits. The fork lift insertion openings can also be provided by a gap between adjacent support members that are located along one side of the container. Thus, another embodiment relates to a container that comprises at least three support members that are located in close proximity to the edge (the outer edge) of one side of the bottom, and at least three oppositely located support members in close proximity to an opposite edge (an opposite outer edge) of the bottom, wherein the at least three support members are configured to provide at least two fork lift openings thereinbetween. It is also possible that the three support members be interconnected along their upper end, i.e. via a bridging plank that extends along the lower surface of the bottom of the container, bridging each pair of thus positioned support members, so as to form a continuous structure along one side of the bottom of the container. An identical structure can be positioned in an opposing position along the other side of the container, providing structural support for the container, as well as means for lifting and transporting the container by e.g. using a fork lift.

The upper rim of the container can have recesses that are of a length that is comparable to the length of the fork lift insertion openings of the support member. The recesses serve the purpose of allowing a fork lift to lift a container that is placed on top of the male container (a female container), as is further described herein. The recesses can have a length that is identical, or nearly identical, to the length of the fork lift insertion openings. When the fork lift insertion openings are provided as slits within the support member structure, the recesses can be of a length that is identical, or nearly identical, to the length of the slits so provided. The recess can also be of a length such that the recess, when viewed from above, is at least as long as the outermost portion of the fork lift insertion openings. Thus, the recess can at least comprise a portion of the rim that starts at a location between one corner of the container and a point that is vertically directly above the outermost part of a fork lift insertion opening on a support member that is disposed on that side of the container, and ends at a location between the next corner of the container and a point that is vertically directly above the outermost part of another fork lift insertion opening on a support member that is disposed on the same side of the container. There can thus be a single recess on a side of the container. In one configuration, there are four recesses on the rim of the container, one on each side of the container. In another configuration, there are two recesses on the rim of the container, on opposing side walls, the recesses being located vertically to support members that are arranged along the same side of the container. The height of recesses is preferably such that it will allow a fork of a fork lift to be inserted through the fork lift openings of an upper container in a stack of containers (a female container, as described herein), without the upper portion of the side wall of the lower container interfering with such insertion. The height of the recess can for example be approximately equal to the height of the fork lift insertion opening, for example when the fork lift insertion opening is provided as a slit. The height of the recess may suitably also range from about one quarter to about three quarters of the height of the fork lift insertion opening.

To provide means for securing and stabilizing a sandwich that comprises a male container and an inverted container (female container) that has been placed on top thereof, as well as to provide structural support to the male container, the male container can contain at least one flange that is positioned on the outside facing surface of at least two opposing side walls. The at least one flange can also be positioned on all four side walls. The flange can be tapered in an upward fashion, at least along a portion of its length. The flange can also be substantially more narrow at its top than at its bottom. For example, the flange can be very thin at its top, so that the upper end of the flange smoothly merges with the side wall of the container. The flange can also be tapered towards the sides along an upper part thereof.

The flange can extend from the bottom of the container, such that the lower end of the flange meets the upper side of the bottom of the container. The flange can also be located at an upward distance from the bottom, so that a gap is present between the bottom and the lower end of the flange. In some embodiments, the container contains two or more flanges, or three or more flanges, along the outward facing surface of at least two opposing side walls. In some embodiments, the container contains three flanges on two opposing side walls. In one embodiment, the male container comprises four flanges, two of which are arranged on one side of the container, and each of which reaching from the corner of the container to a point towards the middle of the outer side wall of the container, and the other two being similarly arranged on an opposing side walls. Preferably, the flanges are of substantially identical shape and arranged in comparable locations on the side wall. It is also possible that two opposing side walls each contain a single flange, that can extend along a substantial portion of the outer surface of the side walls, both flanges being equal in shape and location on each side wall.

The flange can be thickest at its lower end. The thickness of the flange can be adjusted so that when a container (a female container) is placed in an inverted position on top the male container, the inverted container will fit snugly on top of the male container, the side walls of the inverted container being positioned adjacent to, or meeting, the flanges of the male container. This results in a stabilized sandwich of containers. Accordingly, it can be useful to structure the flange such that the horizontal distance from the outer edge of the bottom of the container to the outer edge of the lower end of the flange is approximately equal to the width of the upper rim of the wall of the container. The horizontal distance from the outer edge of the bottom of the male container to the flange can thus be approximately equal to the width of the upper rim of the wall of a female container, as described herein.

The skilled person will appreciate that modifications to the flange structures are possible and are also envisaged. For example, multiple flange structures can be interconnected on the outer surface of the container, so that a single mechanical structure that contains multiple flange portions resides on the outside surface of a single side wall. Such structure will combine the two functional features of the flange, i.e. provide structural support to the container, as well as allowing for stable sandwich-type structure of two containers.

The bottom of the container can have an upper surface that is substantially flat, in other words the surface is not slanted. The bottom surface can also be at least partially slanted, so that when placed on a level surface, liquid in the container will flow towards at least one side of the container. The slant can be from one side of the container, such that liquid in the container will tend to flow towards one side of the container. Preferably, however, the slant starts at the middle of the container, towards at least two sides, preferably all four sides, of the container. The upper surface of the bottom can thus be slanted from its middle towards the sides of the container, so that when placed on a level surface, liquid in the container will flow towards the sides of the container.

There can also be provided at least one drain, that serves the purpose of allowing liquid from the container to be drained. The drain can be provided as one or more drain hole, that can optionally be closable by a suitable stopper, plug, a valve, or by other means known in the art. There can be at least one drain hole arranged on at least one side wall, the drain hole traversing the side wall and being provided as an opening onto the bottom surface of the container, to allow liquid within the container to flow through the drain hole. Preferably, the lowermost surface of the drain hole is approximately level with the upper surface of the bottom of the container. The drain can also be provided such that the drain has a smaller opening into the container than out of the container. In one embodiment, the drain is of a generally circular shape.

The drain hole can have a generally circular profile, but can also have a rectangular, ellipsoidal or other suitable profile. The drain hole will typically have dimensions that allow for free flow of liquid from the container, and the dimensions of the hole will therefore take into account the overall dimensions of the container and the need for draining capabilities. The number and position of drain holes can also be adjusted to provide additional draining capabilities as needed. For example, for certain uses it can be beneficial to have drain holes both in the bottom and lower sides of the container. The diameter of the drain holes can typically be in the range of about 10 mm to about 100 mm, such as about 20 mm to about 100 mm, about 30 mm to about 80 mm, about 40 mm to about 70 mm, or about 50 mm to about 60 mm.

The drain can also be provided as one or many drains, such as drain holes, that are arranged on the bottom of the container. Such arranged drains can be closeable or resealable.

The container can also comprise one or more drain channels that are arranged on the upper side of the bottom of the container. Such drain channels accumulate liquid in the container, for example liquid generated by melting ice in the container, and preferably are fluidly connected to at least one drain holes, to allow for draining from the container through the drain channel and a drain hole. In one embodiment, the drain channel is arranged on the upper surface of the bottom, at a meeting point of the bottom and the side walls, where the bottom meets the side walls. The drain channel can also be provided as multiple channels on the bottom of the container. There can for example be drain channels that extend generally from the middle of the container towards drain channels arranged at the meeting point of the bottom and side walls. Alternatively, there can be one or more drain channel that extends from the middle of the container and feeds directly into a drain hole on, or near, the side of the container.

The invention further provides an open top container (female), that comprises a bottom having an upper surface, a lower surface and an outer edge of each side thereof, the bottom interconnecting four vertical side walls extending from the bottom, wherein the side walls consist of two pairs of oppositely located side walls extending from the bottom to form an opening having a rim around it, and wherein the container further comprises at least one support member that extends downwardly from the lower surface of the bottom in proximity to the outer edge of the bottom, wherein the at least one member is provided with at least two fork lift insertion openings along one side thereof, oppositely located to substantially identical openings on an opposing side of the support member, and wherein the rim has a plurality of recesses, the recesses being vertically aligned with, and being of substantially equal length as, the fork lift insertion openings.

In another aspect, the invention provides a female open top container comprising a substantially rectangular bottom having an upper surface, a lower surface and an outer edge of each side thereof, the bottom interconnecting four substantially vertical side walls extending from the bottom, the side walls consisting of two pairs of oppositely located side walls extending from the bottom to form an opening having a rim around it, the container further comprising at least one support member extending downwardly from the lower surface of the bottom in proximity to the outer edge of the bottom, wherein the at least one support member provides at least two oppositely oriented fork lift insertion openings along opposite sides of the container, and wherein the container further comprises at least one drain, for draining liquid from the container.

The drain can be provided as one or more drain hole, that can optionally be closable by a suitable stopper, plug, a valve, or by other means known in the art, as described in the foregoing for the male container. The drain hole can be arranged and designed as described in the foregoing. The container can furthermore comprise one or more drain channel, which can suitably be arranged as described in the foregoing section describing a male container.

The bottom of the female container can be rectangular in shape, and the four side walls can be vertically upright extending from the outer edge of the bottom, perpendicular to the bottom. This allows for the placement of an inverted female container on top of a male container, as described further herein, so as to form a sandwich-type structure.

The support member can be provided as two support members that are placed in opposite positions in close proximity to the outer edge of the bottom. In such a configuration, the fork lift insertion openings are preferentially provided as oppositely located openings on the two oppositely located support members. The support members can be positioned at the outer edge of the bottom, extending downwardly from the bottom so that the outer surface of the support member forms a continuous structure with the outer edge of the bottom.

The at least one support member can also be provided as a single support member, that can extend along, and be structured downwardly from, the outer edge of the bottom. In one such embodiment, the outer edge of the support member extends vertically downward from the outer edge of the bottom, so as to form a continuous planar surface.

The fork lift insertion openings can be provided as slits within the support member, of dimensions that are suitable for the insertion of a fork of a fork lift. The support member can be a continuous structure, at least along, or in close proximity to, the outer edge of the bottom of the container, extending downwards from the bottom, the structure having fork lift insertion openings provided as slits. The fork lift insertion openings can also be provided by a gap between adjacent support members that are located along one side of the container. Such multiple support members can optionally be interconnected by a bridging member that meets the support members, so as to form a single structure.

The upper rim of the container can have recesses that are of a length that is comparable to the length of the fork lift insertion openings of the support member. The recesses serve the purpose of allowing a fork lift to lift an upper container in a stack of containers, as is further described herein. The recesses can have a length that is identical, or nearly identical, to the length of the fork lift insertion openings. When the fork lift insertion openings are provided as slits within the support member structure, the recesses can be of a length that is identical, or nearly identical, to the length of the slits so provided. The height of recesses is such that it will allow a fork of a fork lift to be inserted through the fork lift openings of a container that is placed on top of the female container (a male container, as described herein), without the upper portion of the side wall of the lower container interfering with such insertion. The height of the recess can for example be approximately equal to the height of the fork lift insertion opening, for example when the fork lift insertion opening is provided as a slit. The height of the recess may suitably also range from about one quarter to about three quarters of the height of the fork lift insertion opening.

In one embodiment, the rim comprises continuous recesses along at least two opposite sides of the container that also have support members arranged close thereto, and wherein each of such recesses is vertically aligned with the thus arranged support members. The recesses can be of a length such that a recess, when viewed from above, is at least as long as the outermost portion of the fork lift insertion openings on the container. Thus, the recess can at least comprise a portion of the rim that starts at a location between one corner of the container and a point that is vertically directly above the outermost part of a fork lift insertion opening on a support member that is disposed on that side of the container, and ends at a location between the next corner of the container and a point that is vertically directly above the outermost part of another fork lift insertion opening on a support member that is disposed on the same side of the container. There can thus be a single recess on a side of the container. In one configuration, there are four recesses on the rim of the container, one on each side of the container. The rim can also have a plurality of recesses, the recesses being vertically aligned with, and at least of equal length as, the fork lift insertion openings.

Similar to the male container described in the above, the bottom of the container can have an upper surface that is substantially flat, in other words the surface is not slanted. The bottom surface can also be at least partially slanted, so that when placed on a level surface, liquid in the container will flow towards at least one side of the container. The slant can be from one side of the container, such that liquid in the container will tend to flow towards one side of the container. Preferably, however, the slant starts at the middle of the container, towards at least two sides, preferably all four sides, of the container. The upper surface of the bottom can thus be slanted from its middle towards the sides of the container, so that when placed on a level surface, liquid in the container will flow towards the sides of the container.

The walls of the male and female containers described in the foregoing can be of substantially equal and uniform thickness (width), i.e. the walls of the male and female containers can be of equal thickness, and the walls can also be uniformly thick, i.e. the thickness at the bottom of the wall is approximately equal to its thickness at its top. It is also possible that the walls of the male or female containers, or both, be slightly thicker at their bottom than at their top. Such a design provides additional structural stability to the containers, and can therefore be advantageous.

The containers can be useful for storage and transport of food items, such as fish, meat, poultry and the like. The containers can also be useful for a variety of other goods of varying sizes and shapes, heavy and light, and their manufacture and dimensions will be adjusted accordingly. It should be appreciated that the containers of the invention can be designed in any dimension suitable for their use. In general, the dimensions of the bottom of the containers (width× length) can be in the range of (about 0.1 to about 10.0 m)×(about 0.1 m to about 10.0 m), such as (about 0.2 m to about 5.0 m)×(about 0.2 to about 5.0 m), such as about (0.3 m to about 3.0 m)×(about 0.3 m to about 3.0 m). In some embodiments the dimensions of the containers can be (0.8 to 1.2 m)×(1.0×1.4 m), such as about (0.9 to 1.1 m)×(1.1 to 1.3 m). The height of the containers can be in the range of about 0.05 to about 4.0 m, such as about 0.1 to about 4.0 m, such as about 0.2 to about 3.0 m, such as about 0.3 to about 2.0 m, such as about 0.4 to about 1.5 m, such as about 0.5 to about 1.4 m, such as about 0.6 to about 1.3 m, such as about 0.7 m to about 1.2 m, such as about 0.8 m to about 1.1, such as about 0.9 to about 1.0 m.

In certain embodiments, the containers of the invention are useful for transporting fish or fish products. The dimensions of the bottom of such containers, male or female, can be in the range (about 0.5 to about 3.0 m)×(about 0.5 to about 3.0) (width× length). The dimensions can also be in the range (about 0.8 m to about 1.2 m)×(about 1.0 m to about 1.4 m) or (about 0.9 m to about 1.1 m)×(about 1.1 m× about 1.3 m). The height of such containers can be range from about 0.2 to about 1.0 m, such as about 0.3 to about 0.8 m, such as about 0.3 to about 0.6 m, such as about 0.4 to about 0.5 m.

In preferred embodiments, the ratio of the length to the width of the containers can be about 2:1, such as about 1.8:1, such as about 1.6:1, such as about 1.4:1, such as about 1.2:1, such as about 1:1. More preferably, the ratio can be about 1.2:1, such as in the range of about 1.1:1 to about 1.3:1.

The male and female containers described herein in the foregoing can be assembled into sandwich-type structures, when one type of container (male or female) is placed in an inverted position on top of the other type of container. The design and structure of the containers is such that the sandwich-type structure that is formed is stable, i.e. the containers fit snugly on top of each other. A further feature of the containers is that they can be assembled in stacks, by four types of stacking, i.e. (a) upright-inverted, i.e. one type of container (male or female) on top of an inverted container of the other type (male or female); (b) upright-upright, i.e. one type of container (male or female) on top of the other type of container, where both containers are in an upright position; (c) inverted-upright, i.e. one type of container (male or female) in an upright position on top of an inverted container of the other type.

As a consequence, stacks of containers can be formed, that alternately comprise male and female containers. Either type of container can be the bottom container in the stack, and that container can either be in an upright or inverted position. Subsequent containers in the stack are of alternate sex, and can be placed in alternate positions with respect to adjacent containers in the stack, i.e. each adjacent pair of containers in the stack can be in an upright-inverted, an upright-upright, or an inverted-upright configuration.

Accordingly, the invention further provides a system of containers that comprises alternately vertically stackable open-topped male and female containers as described in the foregoing description of the male and female containers. The system has the further advantage that it can be realized using male and female container having multiple configurations as described in the foregoing, while retaining the advantage of stable and space-saving stacking capabilities.

In one aspect, the system comprises alternately vertically stackable open-topped male and female containers, each male container and each female container comprising a body comprising a bottom having an upper surface, a lower surface and an outer edge, the bottom interconnecting four substantially upright side walls extending from the bottom, the side walls consisting of two pairs of oppositely placed side walls extending from the bottom to form an opening having a rim, wherein the bottom of male and female containers are of substantially equal length and width, the side walls of the female container extending substantially vertically from the bottom, the side walls of the male container extending angularly inwardly towards an opposing side wall from an inwardly position of the bottom with respect to its outer edge, such that when turned by 180° from an upright position, the walls of the male container will fit within the opening of an upright female container.

The system will typically contain a plurality of open-topped male and female containers. For example, the system can contain two or more open-topped male and female containers. Preferably, the system contains an approximately equal number of male and female containers, wherein adjacent members in the stack are male and female. In general, the stack comprising a total of N members will typically comprise N/2 members of each of male and female containers (if N is an even number). Alternatively, the stack can comprise (N−1)/2 members of one type of container and (N−1)/2+1 members of the other types (if N is an odd number). By way of example, for a stack of 7 members, the bottom being male, alternate female and male members can be stacked on the first member, the stack ending in a male member. As a consequence the stack contains (7−1)/2=3 female members and (7−1)/2+1=4 male members.

The system can further be described by the stabilizing fit between support members of a container and an adjacent container in a stack. Accordingly, in one embodiment, each male member further comprises at least one support member extending downwardly from the lower surface of the bottom in proximity to the outer edge of the bottom, the at least one support member being shaped such that when a male container is stacked in an upright orientation on top of an upright female container, the at least one support member of the male container fits within the rim of the female container such that a peripheral portion of the bottom of the male container meets at least a portion of the rim of the female member.

In a further embodiment, the at least one support member of the male and female containers can be further configured so as to be in close proximity to an upper portion of opposing side walls of an adjacent container in a vertical stack of containers that are in an upright position, so as maintain the stack in a stable state.

In other words, the support members of a male container can fit snugly within the side walls an adjacent upright female container in a stack, and the support members of a female container can fit snugly around the side walls of an adjacent upright male container in a stack (due to the walls of the male container being tilted inwardly).

In a further or alternative aspect, a system is provided, comprising alternately vertically stackable open-topped male and female containers, each male container and each female container comprising a body comprising a bottom having an upper surface, a lower surface and an outer edge, wherein the bottom interconnects four upright side walls extending upwards from the bottom, wherein the side walls consist of two pairs of oppositely positioned side walls that extend from the bottom to form an opening having a rim, wherein the bottom of male and female containers are of approximately equal dimensions (i.e., equal length and width), the side walls of the female container extending approximately vertically from the bottom, the side walls of the male container extending angularly inwardly towards an opposing side wall from an inwardly position of the bottom with respect to its outer edge, such that when turned upside down (i.e., flipped by 180° from an upright position), the walls of the male container will fit within the opening of an upright female container, wherein each male member and each female member further comprise at least one support member extending downwardly from the lower surface of the bottom in proximity to the outer edge of the bottom, wherein the at least one support member is shaped such that (a) when a male container is stacked in an upright orientation on top of an upright female container, the support member of the male container fits within the rim of the female container such that a peripheral portion of the bottom of the male container meets at least a portion of the rim of the female member; (b) when female container is stacked in an upright orientation on top of a male container, the support member of the female container allows the rim of the male container to meet the lower surface of the bottom of the female container at an inwardly position from the edge of the bottom of the female container; and wherein (c) the at least one support member of the male and female containers is configured so as to be in close proximity to an upper portion of opposing side walls of an adjacent container in a vertical stack of containers that are in an upright position, so as maintain the stack in a stable state. In an embodiment, the support member of the male container that fits within the rim of the female container fits inside the upper walls of the female container, towards the middle of the female container.

The side wall of the male member can be further configured such that when a female member is stacked on top of a male member in an inverted orientation, the rim of the female member rests on a substantial portion of the outer edge of the bottom of the male member in close proximity to the lower portion of the male side wall (i.e., the lower portion of the side wall of the male container), so as to maintain the stack in a stable state.

The support members of the male and female containers can also be further configured so as to be engaged in a locked position with support members of an adjacent member within the stack with respect to horizontal movement when a male container is stacked in an upright position on top of an inverted female container. In some embodiments, the bottom of the male and female containers have equal dimensions, i.e. equal length and width.

When an inverted female container is placed on top of an upright male container, the different configuration of the walls of the two types of containers will provide for a snug fit of female containers on top of male containers, providing structural stability to a stack of containers that contain such configuration of containers. The flanges that can be present on the male containers, in addition to providing structural stability to the containers, provide further structural stability to a stack of containers in this configuration.

In general, it should be appreciated that any of the above described structural features of the male and female containers can be implemented in the system of stackable containers, which can contain male and female members with any of the above described features, so as to allow for the stackable function of the containers.

The support members of the male and female containers are structured so as to provide support to the containers, and also to provide structural integrity and support to a stack of containers. Thus, when a male container is stacked in an upright orientation on top of an upright female container, the support member of the male container can fit snugly within the rim of the female container. In some embodiments, the support members of the male container fit snugly within recesses on the rim of the female container, such that the peripheral portion of the bottom of the male container rests on the upper rim of the female container. In other embodiments, the support members of the male container fit inside the upper part of the side walls of the female container, towards the middle of the container. Thereby, when stacked on top of a female container, the periphery of the lower surface of the bottom of the male container will touch the upper rim of the female container on which it is stacked, and simultaneously the support member of the male member touches an upper portion of the inner surface of the side wall of the female container. The support member of the female container can be structured so that when an upright female container is stacked on top of an upright male container, the lower surface of the bottom of the female container rests on the rim of the male container. Due to the inward tilt of the walls of the male container, an inwardly located portion of the bottom of the female container rests on the rim of the male container. Further, the support member of the female container can be structured to fit snugly on top of the male container, i.e. an upper portion of the outer portion of at least two of the walls of the male container will be located very close to, or touch, an inner portion of the support member of the female container. This provides for stability of the stack of containers with respect to horizontal movement, with minimal or no slippage of the containers within the stack.

The containers can be further configured to provide for stable stacking of an upright male container that rests on the top of an inverted female container. In this configuration, the support members of the two types of containers meet such that the two containers are interlocked with respect to horizontal movement. The support member of the male container is thus configured so as to fifth within the support member of the adjacent female container, while simultaneously a peripheral portion of the lower surface of the male bottom rests on the inverted female support member. It is also possible to configure the containers such that in this configuration, the support member of the male containers also rests on top of the lower surface of the female container. The support member of the male container can also be configured to fit inside the support member of the female container, at an inwardly position from the outer edge.

It should be appreciated that when provided with fork lift insertion openings, the containers of the invention further can also be provided with recesses along their upper rim that can allow for the lifting of any desired portion of a stack of containers. Thus, when stacked end-on, i.e. an upright male container on top of an upright female container or vice versa, recesses along the upper rim of the male and female containers are provided such that it is possible to insert a fork through the fork insertion openings on the upper container, through the slits on the lower container, and move the upper container in the stack. For example, the rim of the male and/or female container can comprise continuous recesses along at least two opposite sides of the container that also have support members arranged close thereto, such that each of such recesses is vertically aligned with the thus arranged support members. The slits therefore provide for free movement of the fork of a fork lift or the like when containers are stacked. It is also possible to structure the support members of the male and female containers such that when an upright male container is placed on top of an upright female container, it will be possible to insert a fork into and through fork lift insertion openings on the female container and lift the stack of male and female containers.

It should also be appreciated that by placing an inverted female container on top of an upright male container (or vice versa), a significant amount of space can be saved. This is an important feature for the storage and/or shipping of containers, for example in warehouse or on vessels, where space saving can be critical. The amount of space that is saved by this stacking configuration can be defined by the reduced volume occupied by the stacked containers. The space saving, compared with a stack of identical containers that are stacked in an upright position, can be on the range of about 25-50%, such as about 35-45%, such as about 40%. The stacks are also stable, due to the interlocking features of the design of the individual containers.

In yet another configuration of the system of stackable containers, it is possible to stack pairs of male and female containers, where within each layer of the stack, two identical containers (male of female) are placed side by side. When stacked end-on, i.e. all containers in a stack are upright, containers in adjacent layers in the stack are horizontally rotated by 90° with respect to adjacent layer(s), which when combined with the structural features described by the foregoing features of male and female containers results in a stack of container pairs that is stable with respect to horizontal movement. Further, this configuration allows for stacking of sandwich-type structures of inverted female containers that are placed on top of male containers, wherein two such sandwich-type structures are place side by side in each layer of the stack, adjacent layers of sandwich-type structures being rotated by 90° with respect to adjacent layers. Thereby, a stack of containers can be formed that saves space by virtue of the manner in which female containers are stacked on top of male containers (or vice versa) within the stack. This can result in significant amount of space being saved during shipping and/or storage.

The dimensions of the containers in this configuration can suitably be such that parallel pairs of containers fit within a pallet, which will allow for easy manipulation of stacks of containers by use of a fork lift.

The containers are preferably molded from a thermoplastic polymer material, such as polypropylene or polyethylene. The container can for example by molded from LLDPE, LDPE, HDPE, polyamide (Nylon), polystyrene, polyurethane, polyvinylchloride, acetal, polyphenylene sulfide, polyesters, and the like. Other polymer materials can also be used, such as acrylonitrile butadiene-styrene (ABS) and other copolymers (acetal copolymers).

The containers can be molded by conventional means well known to the skilled person. Preferred methods include rotomolding, although it is contemplated that other methods may as well be used such as injection-molding, compression molding or extrusion blow molding, and other conventional methods may as well be used.

Preferably, the containers are molded as a one-piece construction, that is the containers are molded as a single continuous structural unit. This has the advantage that no post-production assembly is required, which results in a more economical and convenient production.

For added insulation the containers can comprise a double-wall outer shell surrounding an inner core. The inner core preferably comprises a material selected from polyethylene foam and polyurethane foam. The containers can also be double-walled. A double-walled container can for example be produced by rotomolding in order to mold an outer wall shell and subsequently an inner core material can be introduced by injection before the other wall shell is sealed off.

The containers can however also be of single-walled type which can be produced e.g. by rotomolding.

Particular embodiments of the invention will now be described in more detail, referring to the non-limiting drawings.

BRIEF DESCRIPTION OF THE DRAWINGS

FIG. 12 shows two types of stacks of containers according to the invention; (A) stack that is formed by (from below) stacking of upright female container on top of upright male container, followed by an upright male container that is stacked on top of the upright female container, and so on; (B) stack that is formed by (from below) stacking an inverted female container on top of an upright male container, followed by stacking of upright male container on top of the inverted female container, and so on.

DETAILED DESCRIPTION

Figure 1:
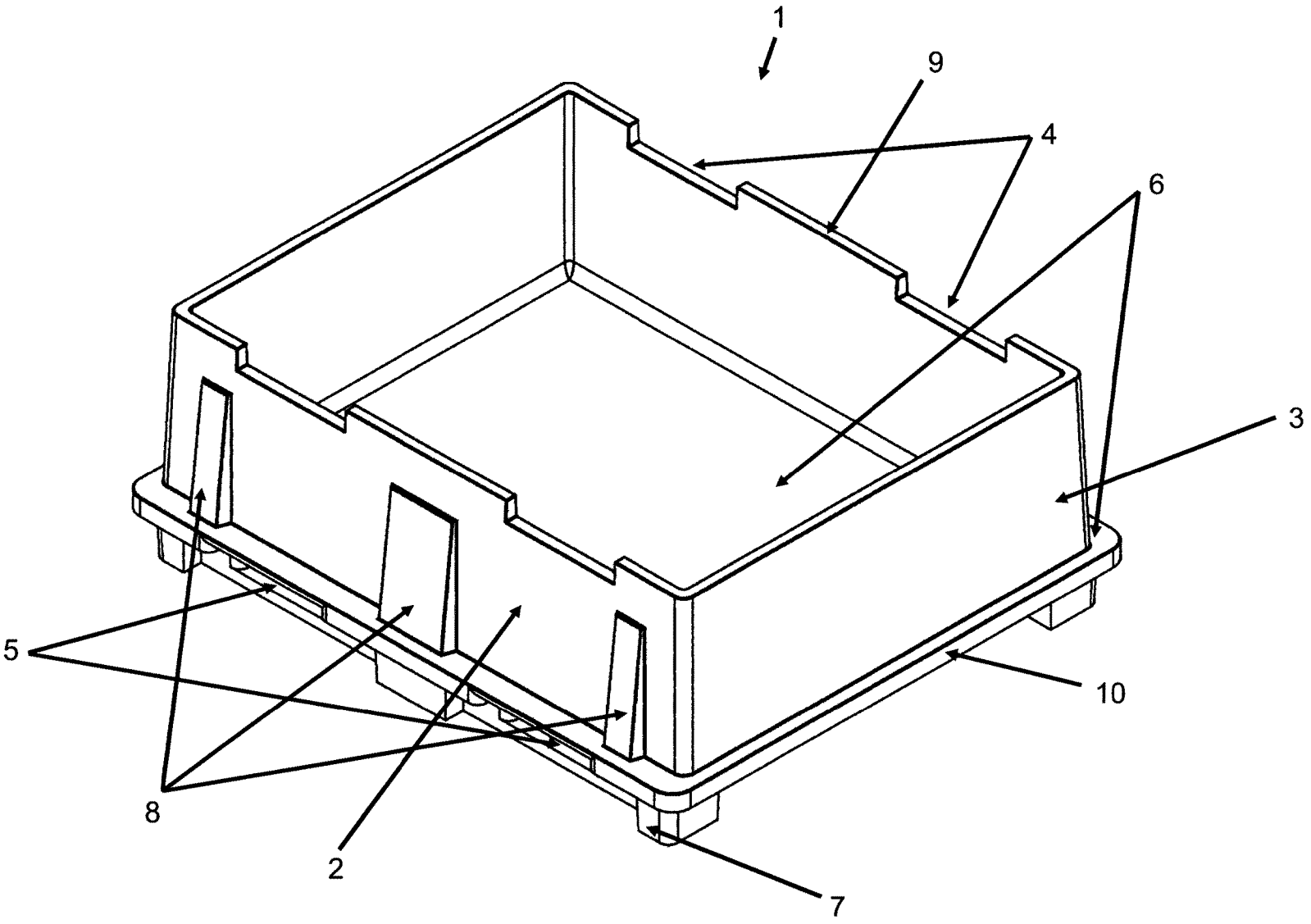
FIG. 1 shows a male container of one embodiment of the invention.

Turning to FIG. 1, a male container 1 is shown, having interconnected side walls 2 and 3 that have an upper edge 9. The side wall 2 is further provided with flanges 8, that extend upwardly from a bottom 6. The side walls 2 and 3 extend from a lower end that is located at an inward position from the outer edge 10 of the bottom 6. The side wall 3 can be seen to extend upwardly and inwardly from the bottom 6, towards an opposing side wall 3. The container has a supporting member 7, that extends downwardly from the bottom 6, parallel to side wall 2, lending support to the container when placed on a flat surface. The support member 7 is further provided with fork lift openings 5, for access of the fork of a fork lift. The container has an identical side wall 2 oppositely located to the shown side wall 2.

Figure 2:
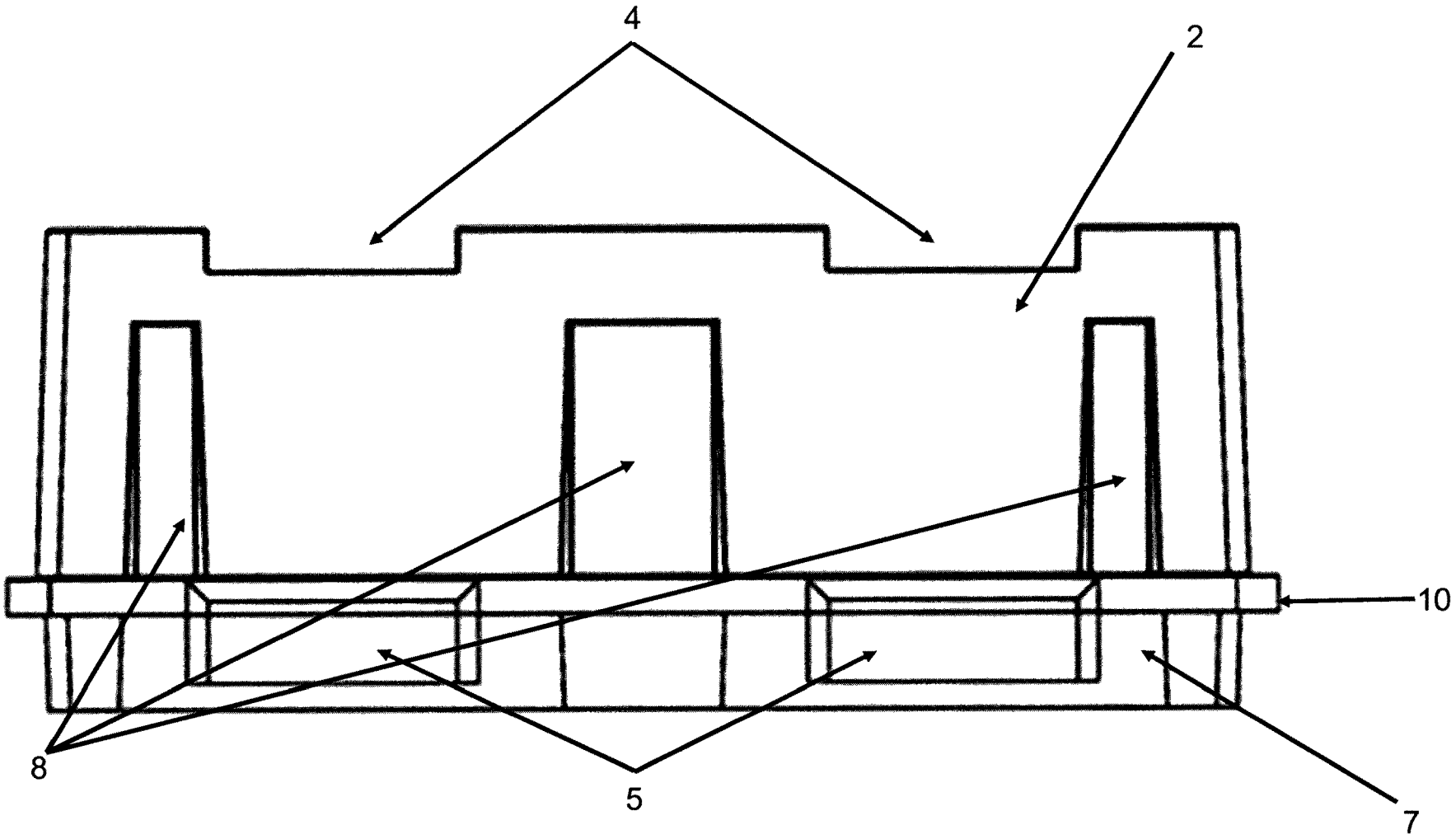
FIG. 2 shows a side view along one side wall of a male container.
Figure 3:
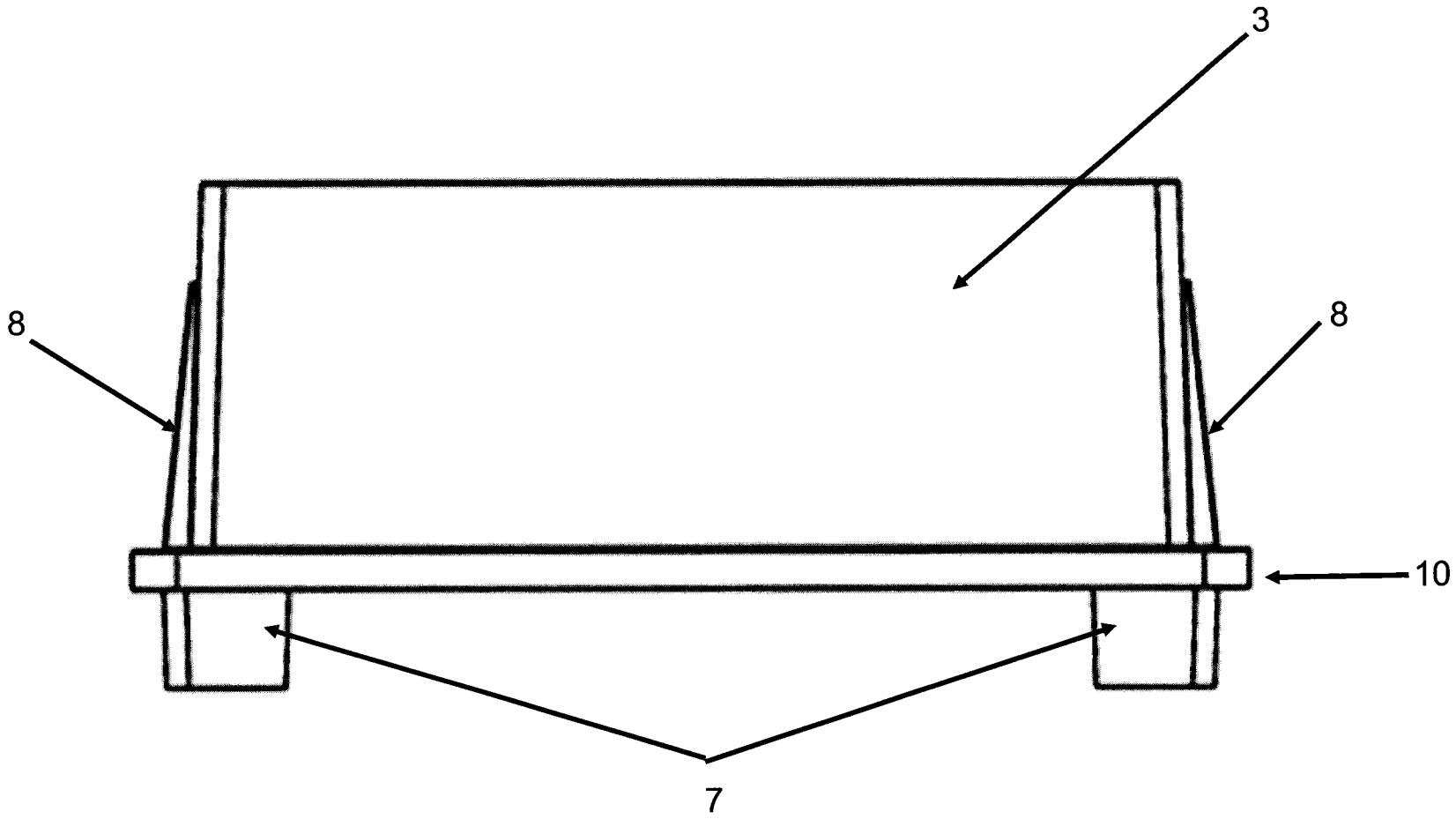
FIG. 3 shows a side view along the other side wall of a male container.
Figure 4:
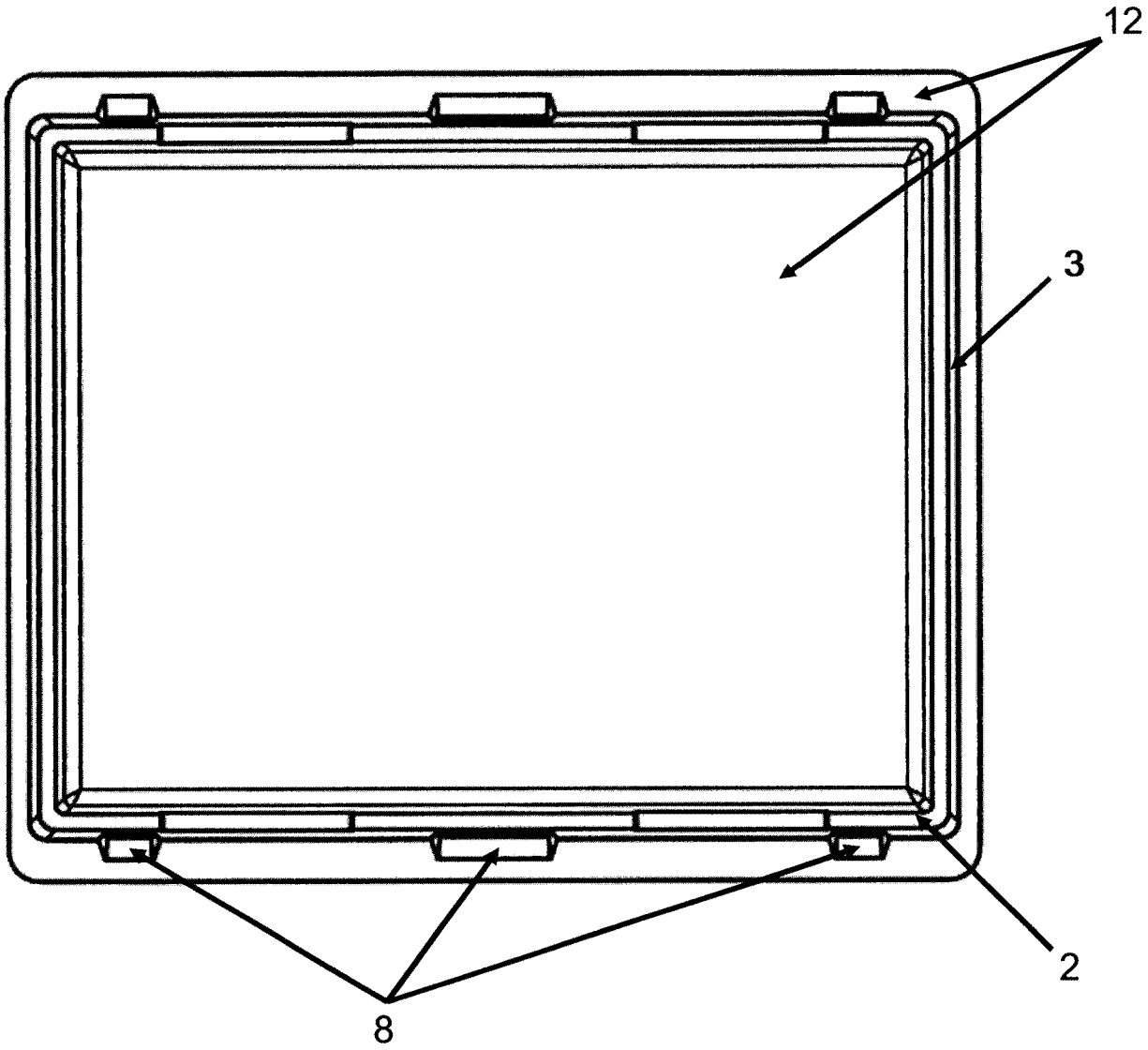
FIG. 4 shows a top view of a male container.

A side view of the container 1 is shown in FIG. 2 and FIG. 3, showing side walls 2, 3 that have an inwardly tilt. Flanges 8 extend from the bottom and are substantially thinner at their upper end than at their lower end, which is located at a distance from the outer edge 10 of the bottom of the container. A gap exists between the lower end of the flanges and the outer edge of the container, which allows a female container of suitable dimensions to be placed in an inverted position on top of the male container, such that the female container rests on the upper surface of the bottom. A top view of the container 1 shown in FIG. 4 showing the opening of the container. An outer portion of the upper surface 12 extends beyond the bottom of the side walls 2,3, such that an inverted female container can be placed on top of the male container.

Figure 5:
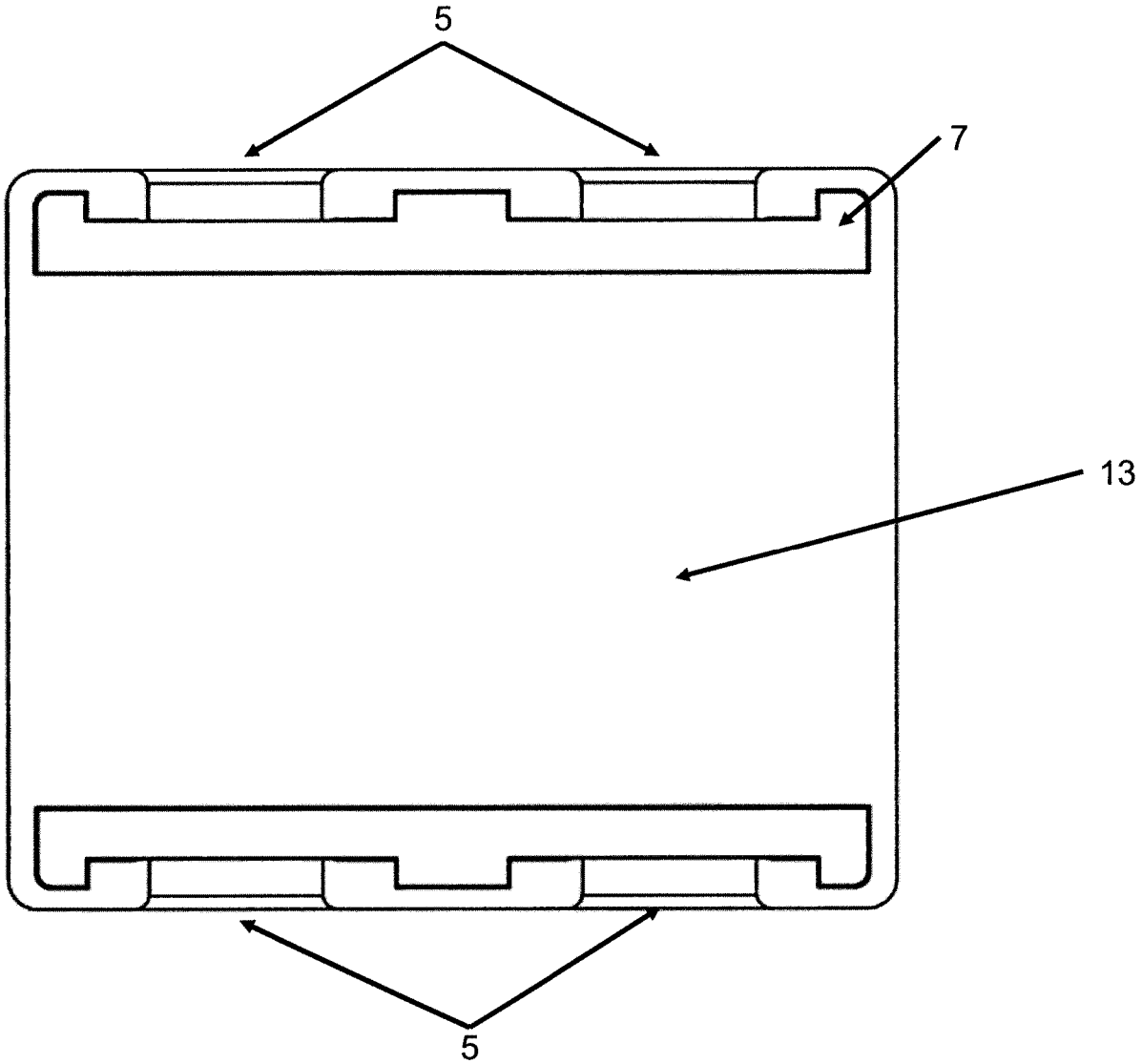
FIG. 5 shows a bottom view of a male container.

A bottom view of the container 1 is provided in FIG. 5, showing the two oppositely located support members 7 that extend from the lower surface 13 of the bottom 11, parallel to side wall 2. Oppositely located fork lift insertion openings 5 are located on the pair of support members, allowing a fork lift to lift and transfer the container.

Figure 6:
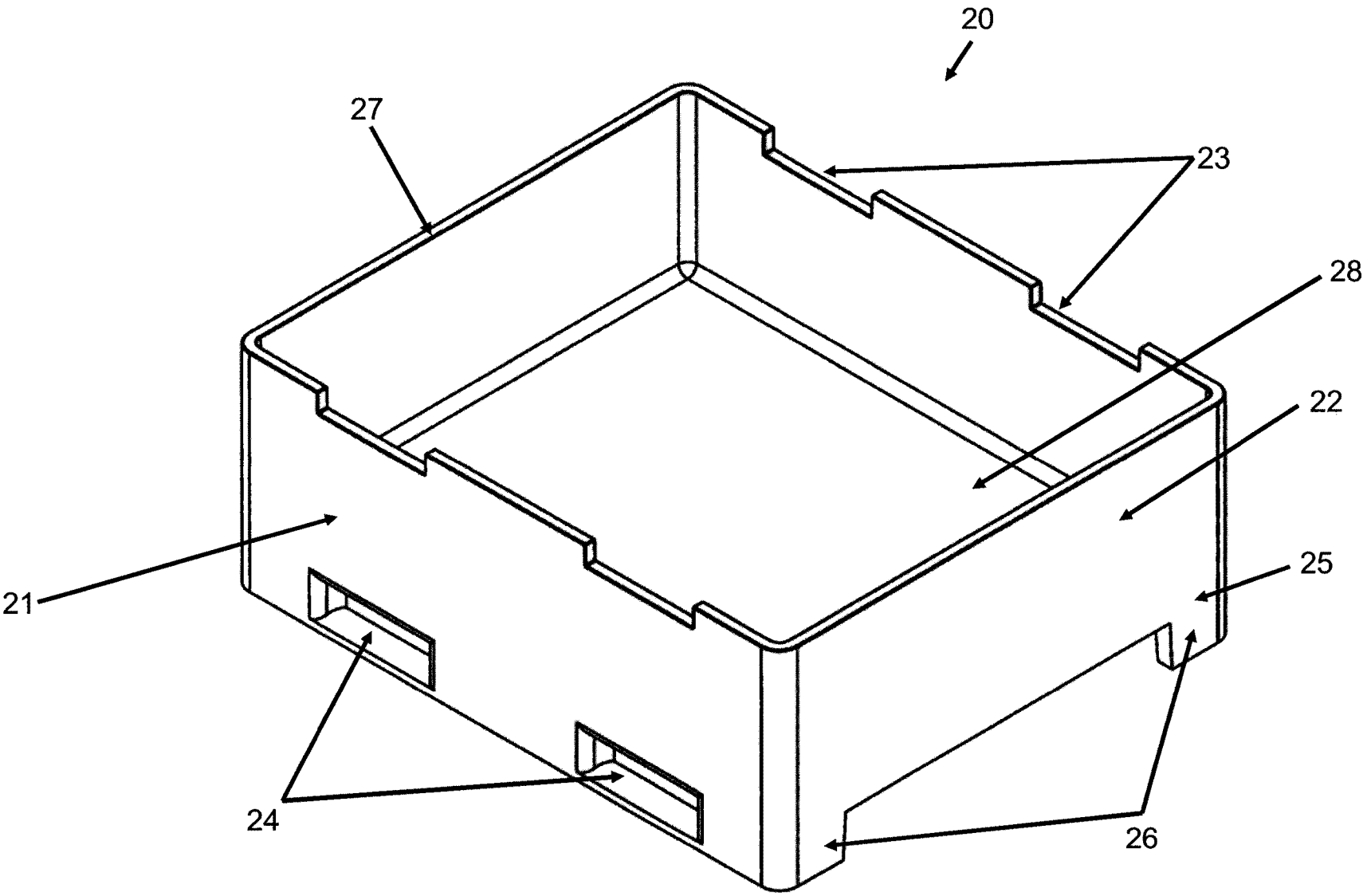
FIG. 6 shows a female container of one embodiment of the invention.

Turning to FIG. 6, a female container 20 is illustrated, having side walls 21, 22. The side walls extend upwardly from an outer edge 25 of the bottom 28, perpendicular to the surface of the bottom. Support members 26 extends downwardly from the outer edge of the bottom 28. Thereby, the side wall 21, the outer edge of the bottom 28 and the support member 26 form a continuous outer surface that extends approximately perpendicularly upwardly when the container is positioned on the ground. As further illustrated by FIG. 6, the support member 26 has fork lift insertion openings 24, that are oppositely located to an oppositely located support member 26 that extends downwardly from the bottom 28 at the opposite outer edge of the bottom.

Figure 7:
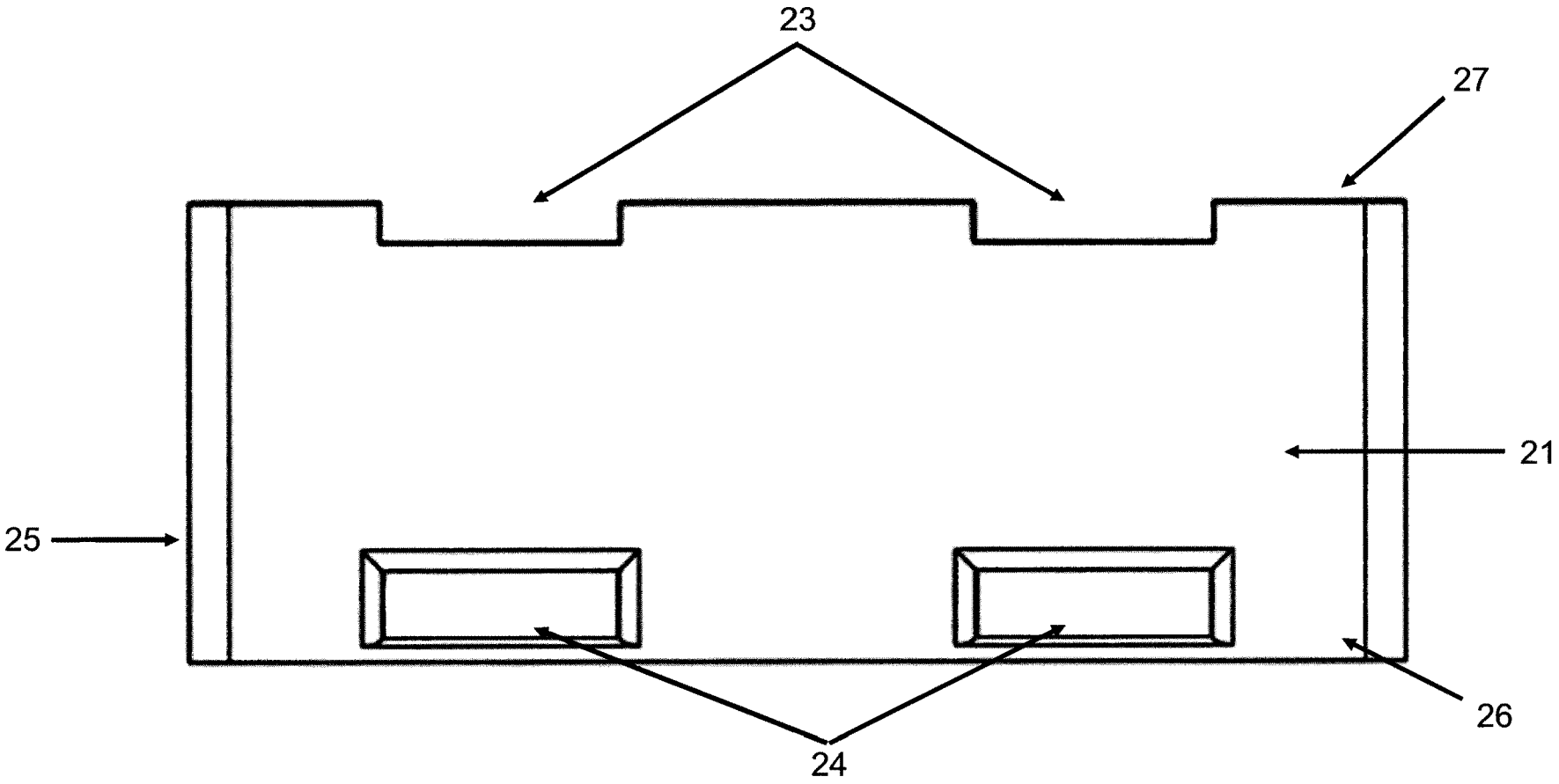
FIG. 7 shows a side view of one side wall of a female container.
Figure 8:
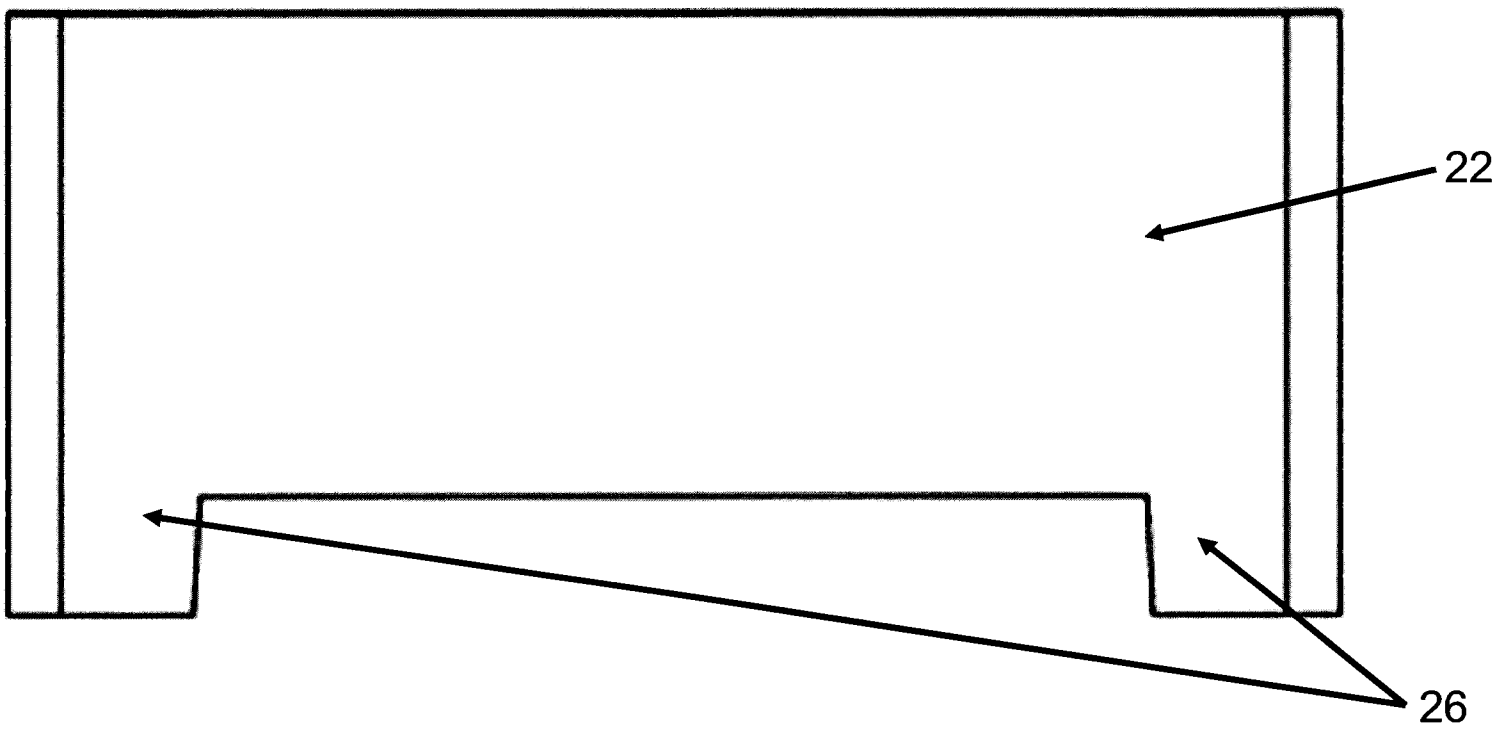
FIG. 8 shows a side view along the other side wall of a female container.

In FIG. 7 and FIG. 8, side views of the female container are shown, illustrating in FIG. 7 the position of recesses 23 positioned along the upper rim 27 of the side wall 21, located perpendicular from, and aligned with, fork lift insertion openings 24 within support members 26 of the container.

Figure 9:
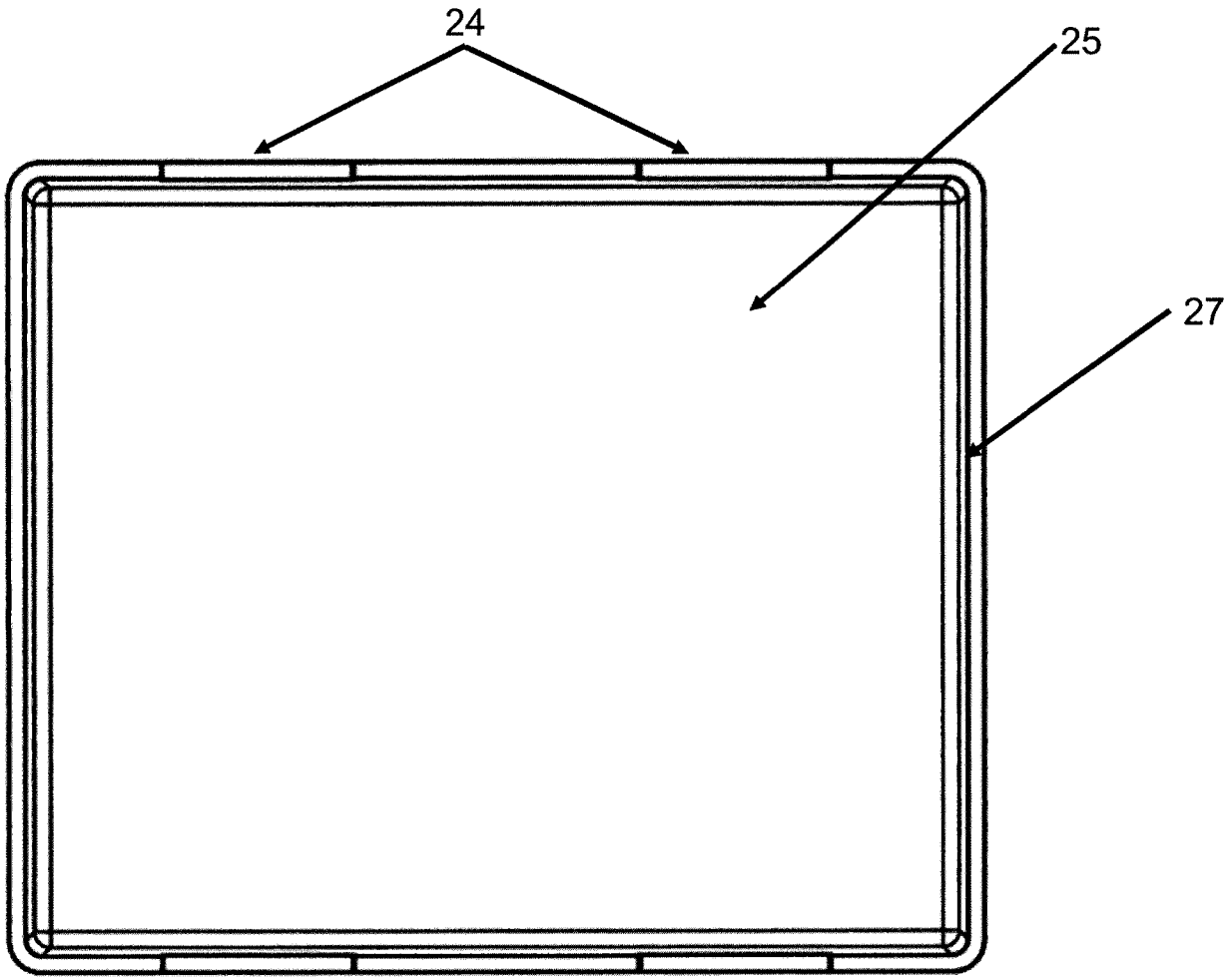
FIG. 9 shows a top view of a female container.
Figure 10:
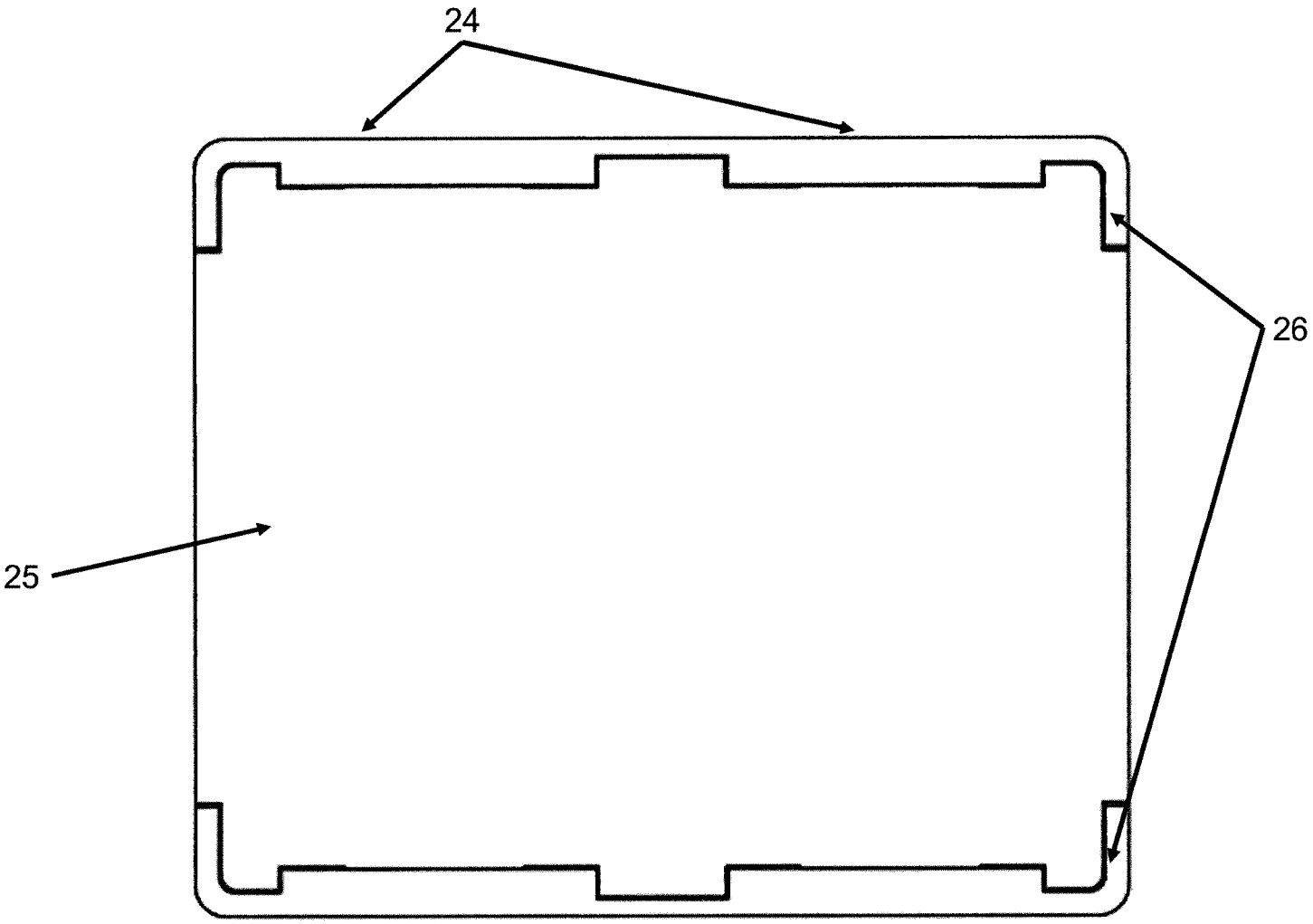
FIG. 10 shows a bottom view of a female container.
Figure 11B:
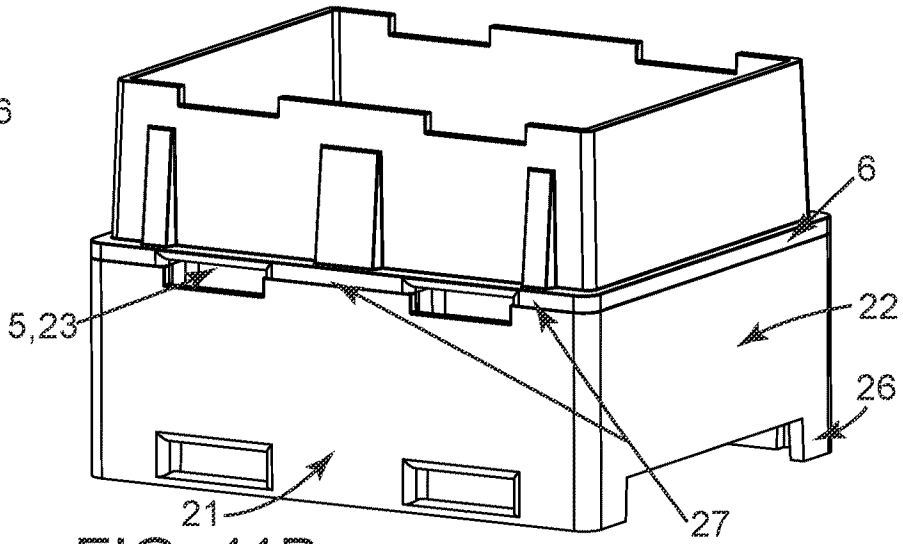
FIG. 11 shows four different stacking configurations of the containers according to the invention; (A) inverted female container on top of an upright male container; (B) upright male container on top of an upright female container; (C) upright female container on top of an upright male container; (D) upright male container on top of an inverted female container.
Figure 11D:
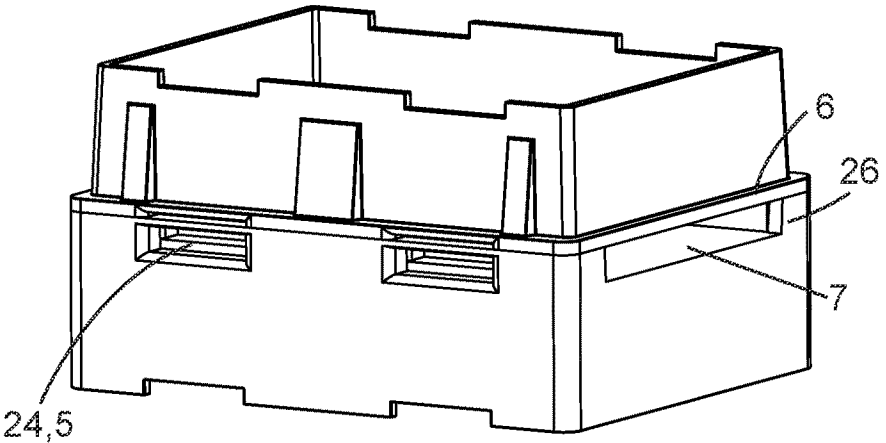
Figure 11A:
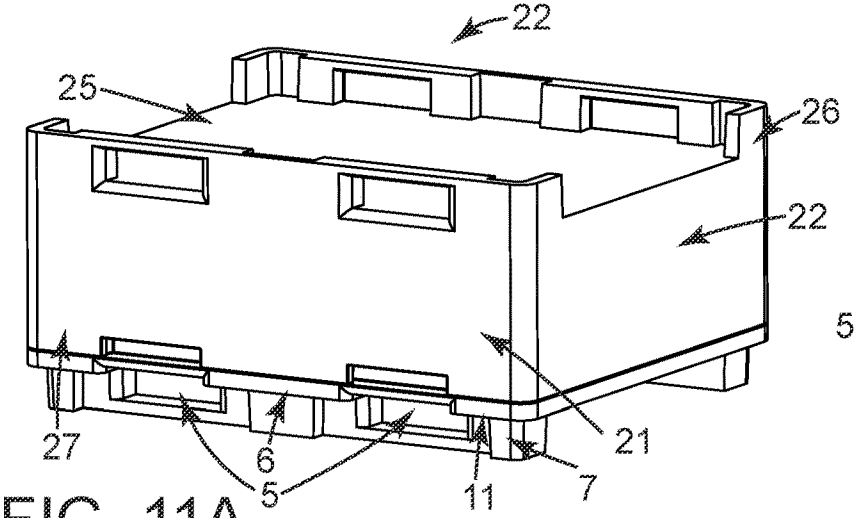
Figure 11C:
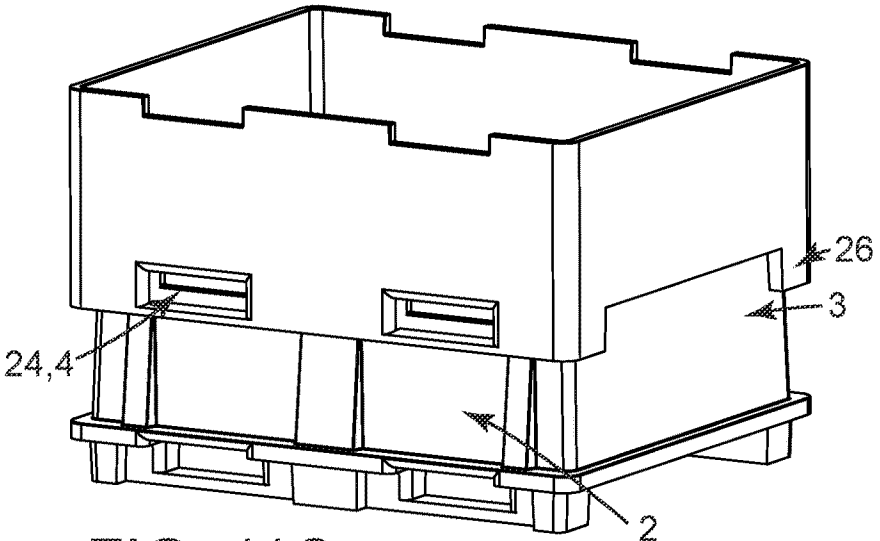

A top view of the female container, shown in FIG. 9, shows an upper rim 27 of the container 2, its opening and the upper surface of the bottom 25. Position of oppositely located fork lift insertion openings 24 is also illustrated. With further aid from FIG. 10, showing a bottom view of the container, the position of the fork lift insertion openings 24 is shown, a pair of which is provided on each support member 26, opposite to identical openings on an identical support member.

The design of the containers allows for stacking of the containers that provides for stable stacks and space saving of empty containers. Thus, male and female containers can be alternately stacked so that a stack of containers is formed that contains male and female containers in the alternate. Further the containers are designed such that they can be stacked in different configuration, each being stable with respect to horizontal movement, due to the design of the male and female containers.

Thus, turning to FIG. 11, the male and female containers can be stacked in several different configurations, as shown by the four different illustrations. The top illustration A shows a "sandwich" of a female container 20 that has been inverted and placed on top of a male container 1. In this configuration, the upper rim 27 of the female container rests on the upper surface of the bottom 6 of the male container, along its outer edge 11, resulting in a snug fit of the female container on top of the male container. The result is a sandwich of male of female containers that is stable and provides significant space savings during the storing of the containers, compared with a configuration in which each container takes up a volume of space that is equal to the volume of the container. The sandwich of containers rests on the support members 7 of the lower male container. Fork lift insertion openings 5 allow for the lifting and transfer of the sandwich of containers. Additional "sandwiches" of containers can be placed on top of the sandwich, with the support members 7 of the next male container in the stack fitting snugly inside the support members 26 of the inverted female container, and simultaneously resting on the lower surface 25 of the inverted female container, to provide stable stacking of additional sandwiches of male and female containers. A stack of alternately stacked male and inverted female containers is further illustrated in the right illustration B of FIG. 12.

In illustration B of FIG. 11, a stack of an upright male container resting on top of an upright female container is shown. In this configuration, a peripheral portion of the lower surface of the bottom 6 of the male containers rests on top of the upper rim 27 of the female container. The support members 7 of the male container fit snugly within the opening of the female container, being simultaneously in close proximity to an upper portion of the side walls 21, 22 inside the female container, close to the upper rim, so as to provide stability with respect to horizontal movement. Fork lift insertion openings 5 in the support member of the male container are aligned with recesses 23 in the female container, so that a fork lift can lift the male container, or a stack of containers that are on top of the female container and have a male member as their bottom member, from the stack.

Turning to illustration C, an upright female container is shown on top an upright male container. An upper portion of the side walls 2,3 of the male containers fits snugly within the support members 26 of the female containers, such that the upper rim of the male container meets the lower surface of the bottom of the female container. The resulting stack is stable with respect to horizontal movement. The fork lift insertion openings 24 of the female container are aligned with recesses 4 in the wall 2 of the male container, allowing for the insertion of a fork through the stack, so that the upper female container, or a stack of containers that have a female container as its bottom member can be lifted and transported from the stack.

Figure 12A:
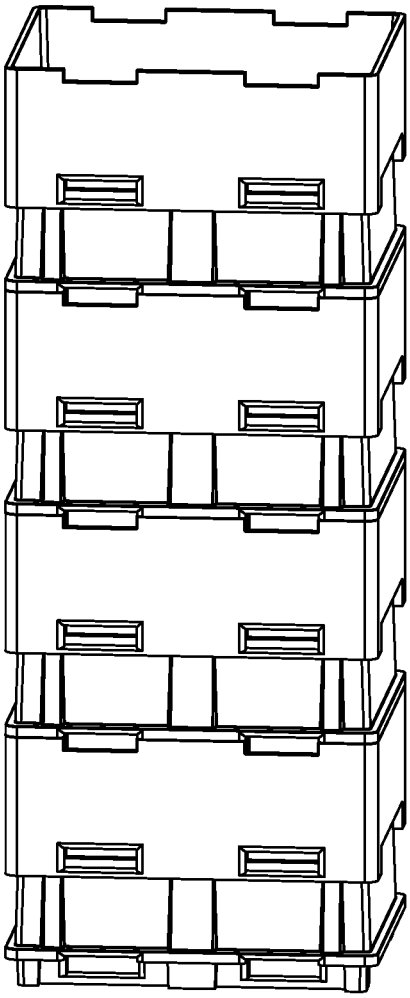
Figure 12B:
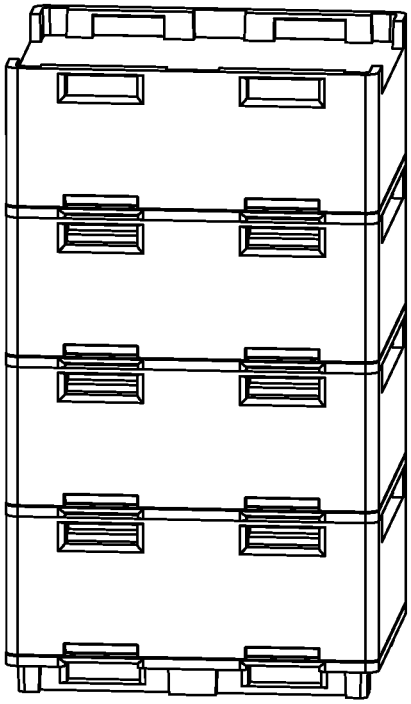

A stack of containers, female and male in the alternate, can thus be formed as shown in illustration A of FIG. 12. The snug fit of support members of the male and female containers with an upper portion of the side walls of a lower member of the opposite sex in the stack, which also, via its upper rim, meets the lower surface of the bottom of an adjacent and upper member, provides for structural stability of the stack. Further, fork lift insertion openings that are aligned with recesses along the upper rim of side walls, provide the possibility of lifting and moving any portion of the stack of containers. Another advantage of this stacking is provided by space saving, since the stack of containers occupy a smaller space than combined individual containers. The containers in this configuration can either be empty, or they can be filled, e.g. with food items. Adjacent upper members within the stack provide a lid or cap for lower members in the stack, which can be important for example during transport or storage of items that are sensitive to air flow, temperature fluctuations, etc.

Illustration D in FIG. 11 shows yet another stacking configuration, in which an upright male container is placed on top of an inverted female container. Here, support members 7, 26 of the adjacent containers meet, such that the male support member 7 sits on top of the lower surface 25 of the bottom of the female container, and fits within the support members 26 of the female container. A peripheral portion of the lower surface of the bottom of the male container simultaneously rests on top of the support members of the inverted female container. As a result, the two containers are interlocked with respect to horizontal movement, and the weight of the upper container is distributed between the bottom and support members of the lower containers. In this configuration, additional containers can be placed on top of the upper male container, e.g. an upright female container or an inverted female container, and so on.

Thus, stacks of containers of the present invention can be formed, wherein within each vertical stack, male and female containers are alternately provided. The containers can further be provided in an upright or inverted configuration with respect to an horizontal axis, i.e. containers within the stack can either be upright or they can be rotated by 180° with respect to a horizontal axis. Stacks of containers can thus be provided, with different configurations of adjacent members in the stack as indicated in FIG. 11.

Figure 13A:
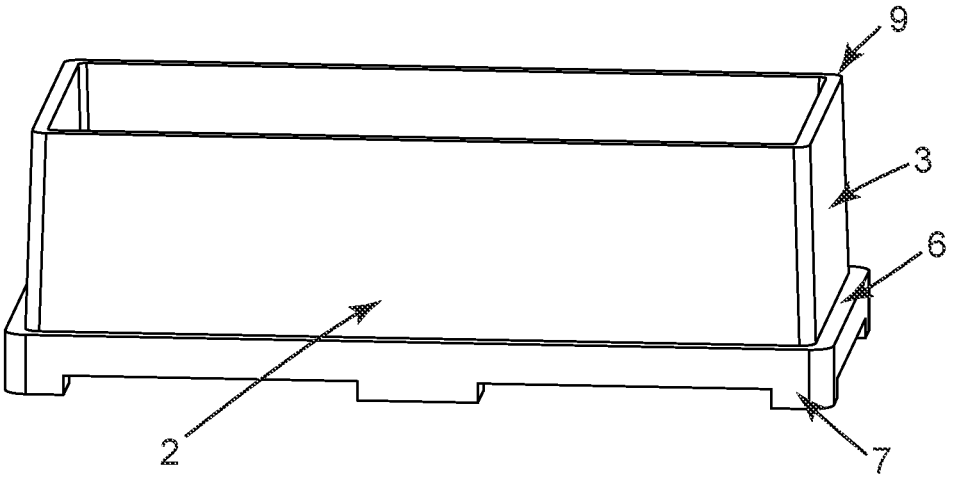
FIG. 13 shows male (A) and female (B) containers according to another embodiment of the invention.
Figure 13B:
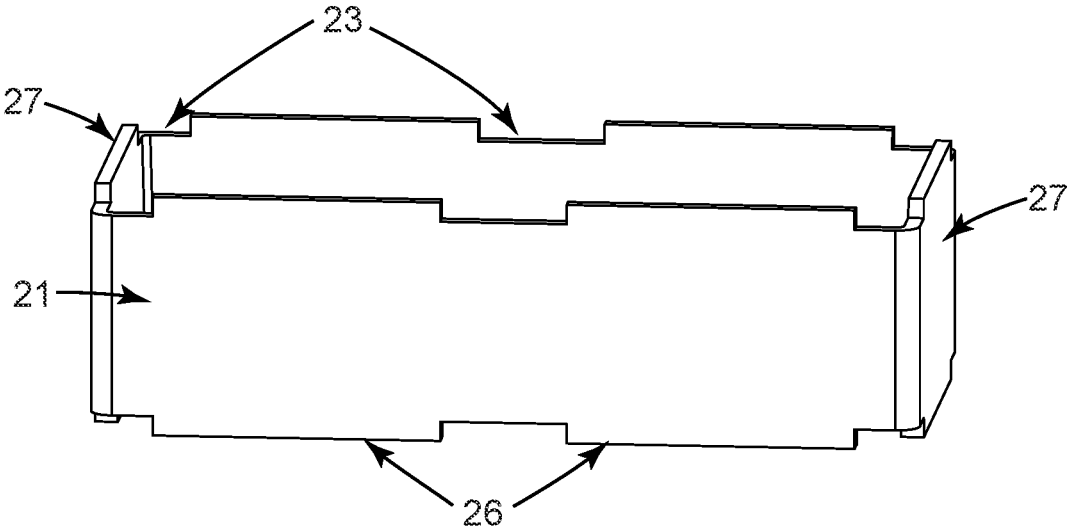

In FIG. 13, male and female containers with a slightly different configuration, but same overall functionality, are shown. The male container A (on the right) has side walls 2,3 that extend from a bottom 6, and are tilted inwardly with respect to the bottom, towards opposing walls. The walls have an upper rim 9 that extends along an opening of the container. Support members 7 are provided, that extend downwardly from the bottom 6. The female container B (on the left) has side walls 21, 22 that extend vertically from a bottom and have an upper rim 27 that extends along the opening of the container. The container further has recesses 23 along the upper rim, and support members 26 that extends downwardly from the bottom.

Figure 14:
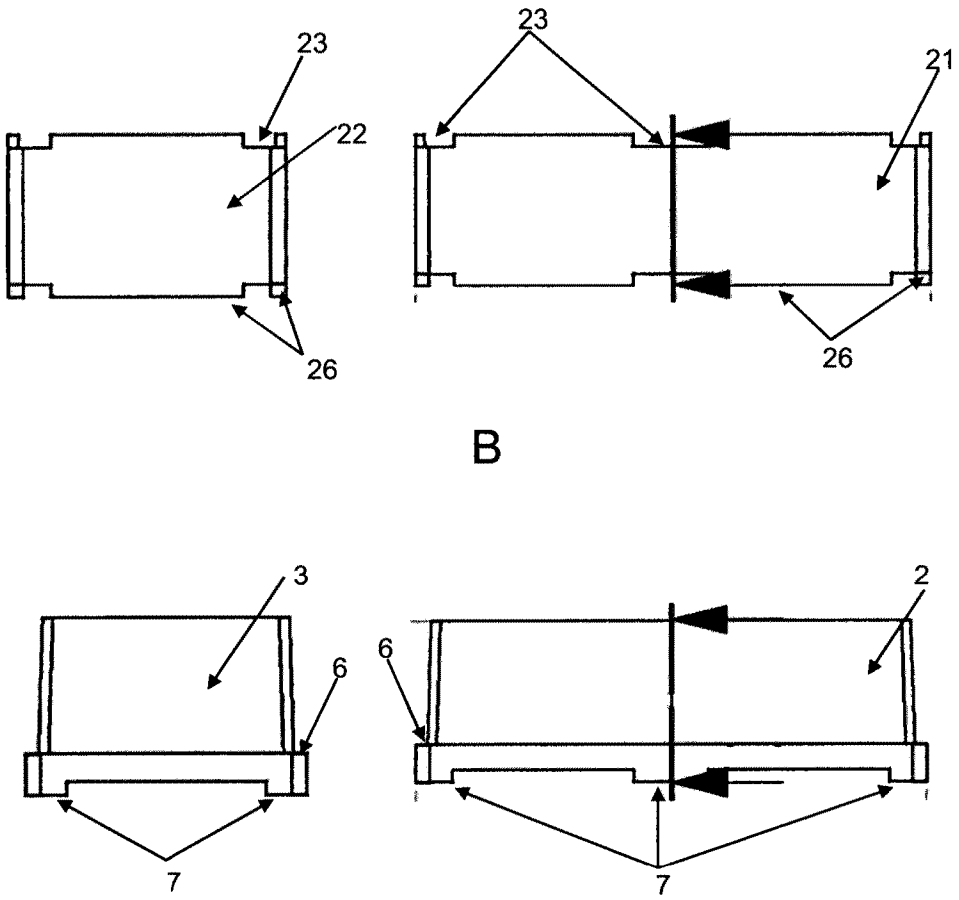
FIG. 14 shows a side views and of male (A) and female (B) containers of FIG. 13.

Side views A and B showing a short wall and a long wall of the containers are indicated in FIG. 14. This view shows the tilt of the side walls 2, 3 of the male container, which have a lower end that is located inwardly from the outer edge of the bottom 6. This allows for stacking of an inverted female container on top of the male container, which rests on the support members 7.

Figure 15A:
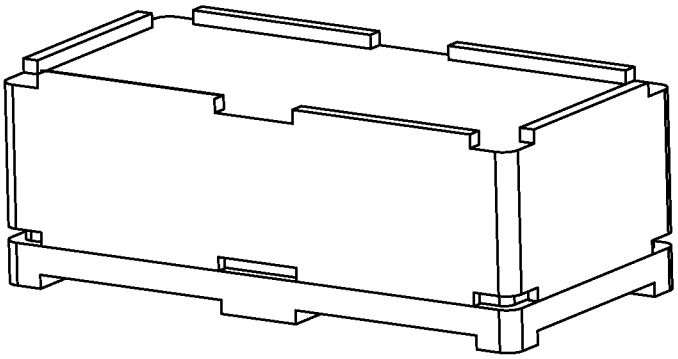
FIG. 15 shows stacking configurations of containers as shown in FIG. 13, wherein (A) an inverted female container is stacked on top of an upright male container; (B) an upright male container is stacked on top of an upright female container; (C) an upright female container is stacked on top of an upright male container.
Figure 15B:
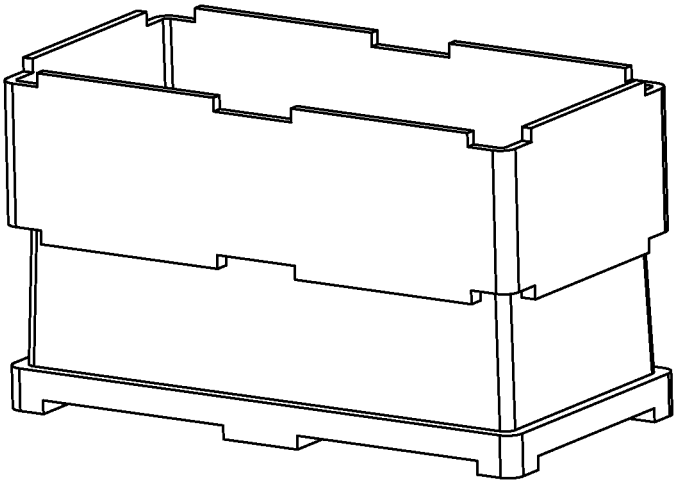
Figure 15C:
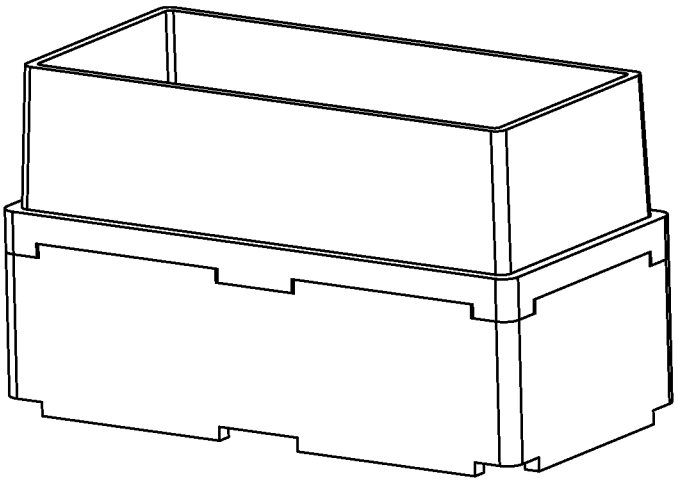

The male and female container in this configuration are alternately stackable as shown in FIG. 15, wherein in A, a female container is stacked in an inverted position on top of an upright male container, such that the upper rim 27 of the female container rests on top of the bottom 6 of the male container. The side walls of the male container are located inwardly from the outer edge of the bottom such that the inverted female container fits snugly on top of the outer edge of the bottom of the male container, so as to provide a stable sandwich structure. Further, the support members 7 of the male containers are structured so as to fit snugly in spaces between support members 26 of the inverted female container, so that the support members of an upright male container can rest on top of the lower surface of the bottom 25 of an inverted female container within the spaces between the support members of the female containers, so as to provide for a stable stacking configuration.

In B, a male container is stacked on top of a female container. Here, the support members 7 of the male container fit snugly within recesses 23 along the upper rim of the walls of the female container, such that the two containers are interlocked with respect to horizontal movement.

In C, an upright female container rests on top of an upright male container. Due to the side walls 2,3 of the male container being tilted inwardly, the female container rests on top of the male container such that the upper rim 9 of the male container meets the bottom 25 of the female container. In this configuration, the support members 26 of the female container are adjacent to, and in close proximity with, an upper region of the side walls of the male container, so that the stack of containers is stable with respect to horizontal movement.

Thus, through the different stacking possibilities of the containers, stacks of containers can be formed, wherein male and female containers are placed alternately in the vertical stack, inverted female container on top of an upright male container, upright male container on top of an upright female container, upright female container on top of an upright male container, or upright male container on top of an inverted female container. The stacking of inverted female containers on top of upright male containers provides for substantial space savings when storing or transporting empty containers.

Figure 16A:
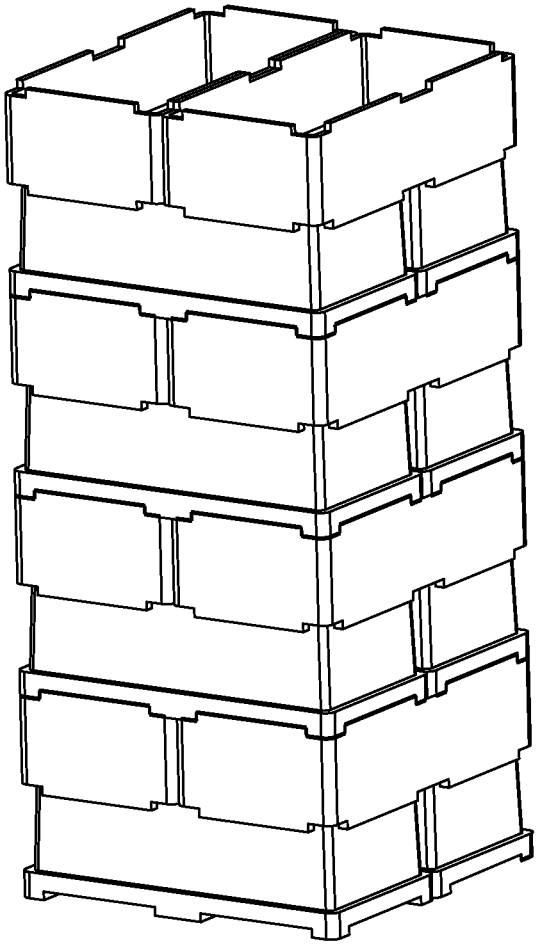
FIG. 16 shows two stacking configurations of pairs of male and female containers as shown in FIG. 13, each pair fitting on a conventional pellet, wherein (from bottom) (A) a pair of upright female containers is stacked on top of a pair of male containers, and a pair of male containers is stacked on top of the first pair of female containers, and so on, wherein adjacent pairs in the stack are rotated by 90° along a vertical axis with respect to adjacent pairs in the stack; (B) a pair of inverted female containers is stacked on top of an upright pair of male containers, and a pair of upright male containers is stacked on top the first pair of inverted female containers, and so on, wherein adjacent pairs in the stack are rotated by 90° along a vertical axis with respect to adjacent pairs in the stack.
Figure 16B:
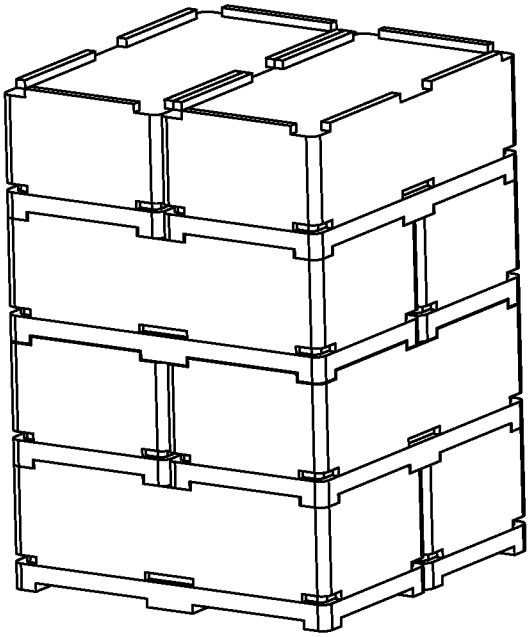

In FIG. 16, an embodiment is shown, in which the dimensions of the male and female containers shown in FIG. 13-15 are such that when placed side by side, the containers fit snugly on a pellet, which allows for easy transport of the containers. Two types of stacks of containers are shown. On the left (A), upright female containers positioned side by side, are stacked on top of two upright male containers, that are also placed side by side. Further, the female containers are rotated by 90° along a vertical axis with respect to the male containers. Each pair of parallel containers in the stack fit snugly on top of the lower pair of containers in the stack. Further, the alternate orientation of the containers provides for additional stability of the stack, due to the interlocking nature of the stack, whereby movement of the stack perpendicular to the longer side of each pair of containers in the stack is prevented by the snug fit of upper pairs of containers in the stack with the adjacent lower pair of containers. Thus, stable stacks of pairs of containers are formed, that can optionally be transferred by a fork lift, when placed on top of a conventional pellet with fork lift insertion openings. On the right (B), pairs of parallel female containers are placed in an inverted position on top of pairs of parallel upright male container in each layer of the stack. Further sandwiches of pairs of inverted female containers on top of upright male containers are placed on top of the initial sandwich pair in the stack, each subsequent sandwich pair being rotated by 90° with respect to a vertical. In this manner, a stack of containers is formed that (i) is stable with respect to horizontal movement, due to the interlocking nature of the stacking, and (ii) provides for significant space savings, due to fact that female containers fit snugly on top of male containers. A comparison of FIGS. A and B shows the space savings clearly, each stack containing the same number of containers.

Figure 17:
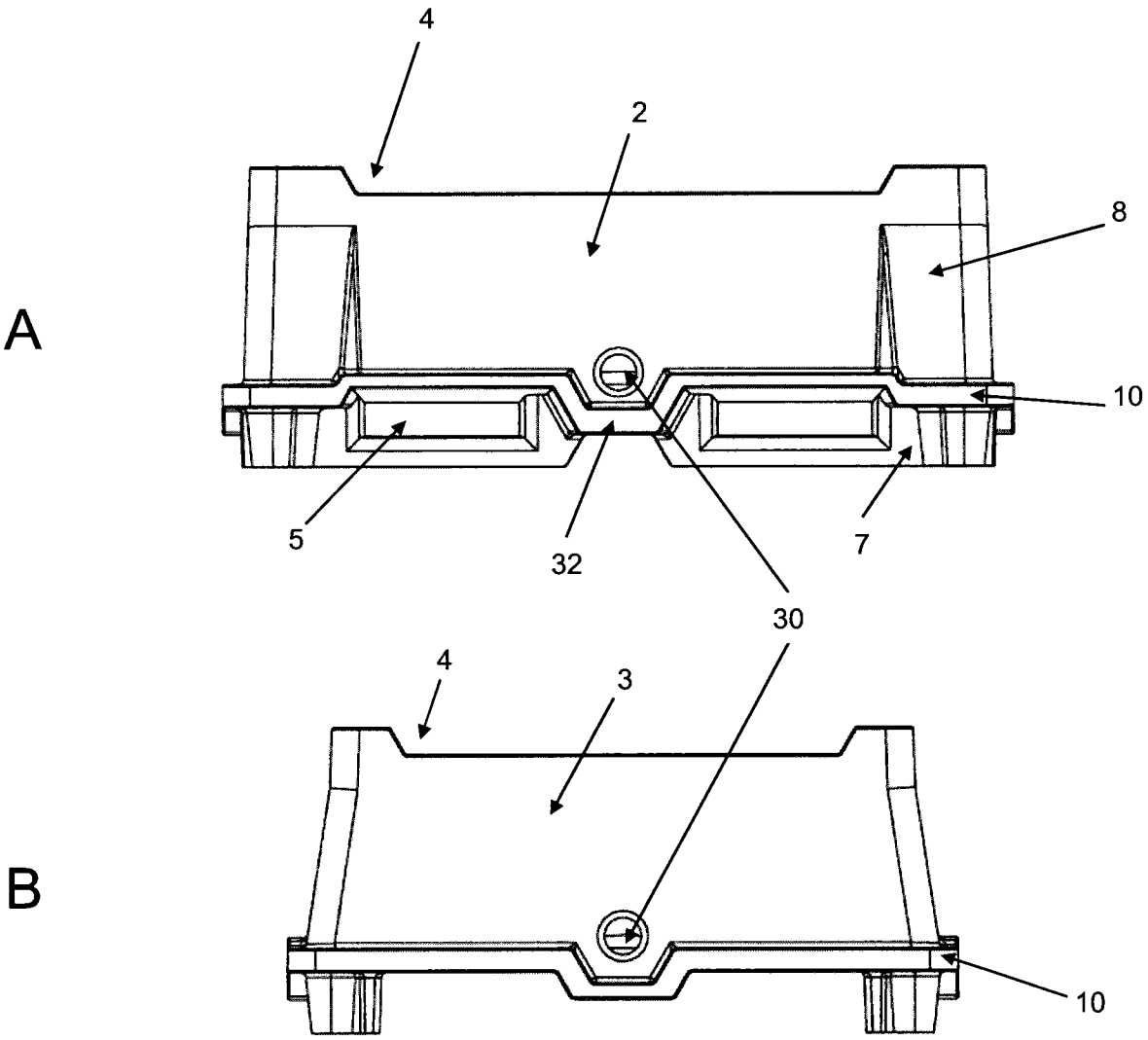
FIG. 17 shows a side views (A) and (B) of an alternative embodiment of male containers in accordance with the invention.

An alternative embodiment of male containers in accordance with the invention is shown in FIG. 17. Side views (A) and (B) are shown along a long side and short side of the container, respectively. In (A) flanges 8 are shown on the long side wall, extending from the upper surface of the bottom 6 at both ends of the side wall, extending to the end of the wall. An elongated recess 4 is shown, both on the long side wall and the short side wall (shown in B). The recess on the long side wall is vertically aligned with the two fork lift insertion openings 5. Drain holes 30 are shown on both side walls, that allow liquid to be drained from the container. The outer edge 10 of the bottom has a slightly irregular surface along the side wall, there being a deflection 32 to accommodate the drain hole 30 and a slight elevation vertical to the fork lift insertion openings 5. Along the short side (B), there is also a slight deflection to allow for the drain hole 30 along this side wall also.

Figure 18:
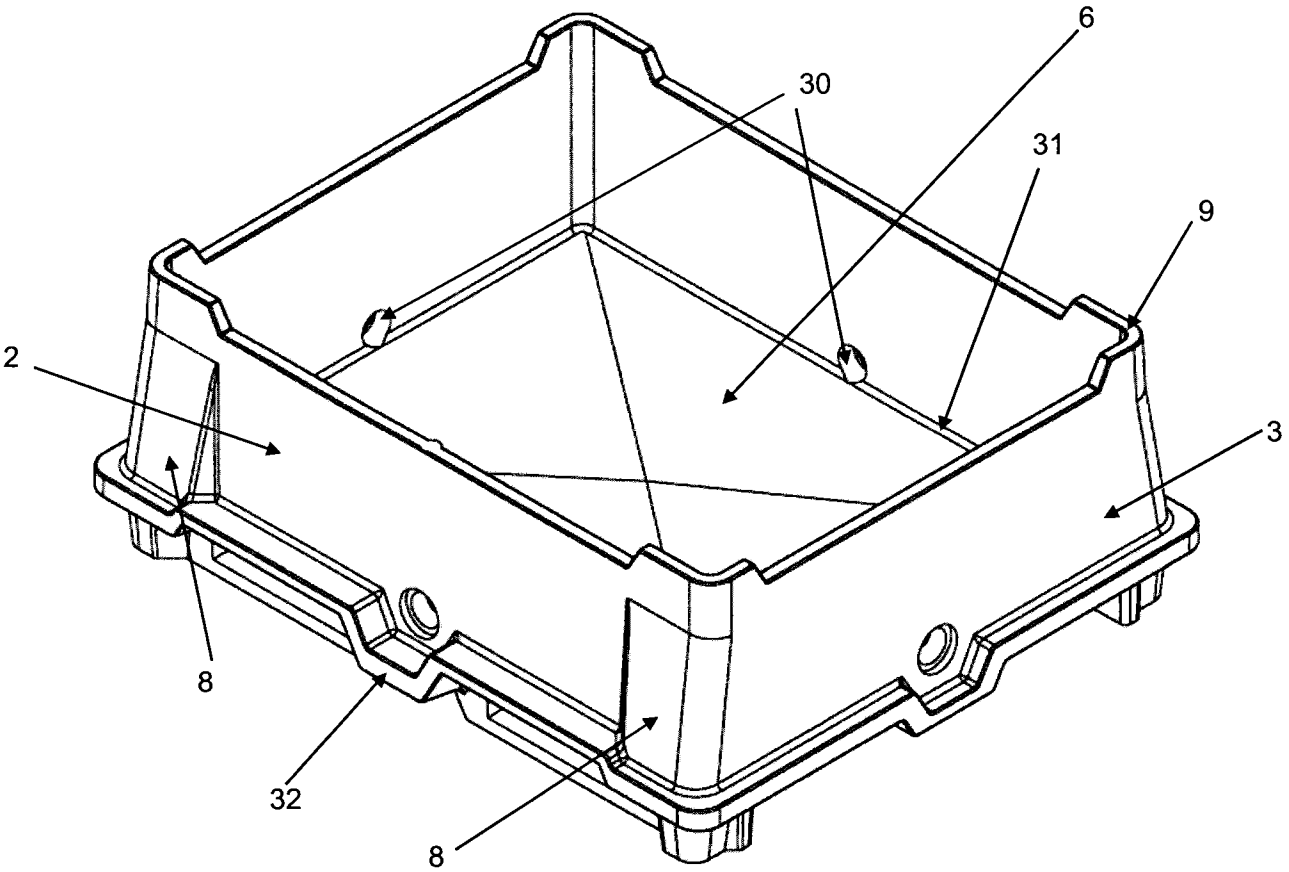
FIG. 18 shows a bird's eye view of a male container of an alternative embodiment of containers in accordance with the invention.

A bird's eye view of the alternative male container is shown in FIG. 18. Here it can be seen that the side walls are tilted towards the middle and that the flanges 8 that are arranged on the side wall 2 extend to the corner, where side walls 2, 3 meet. Drain channel 31 is arranged where the bottom 6 meets the inner side walls. Further, drain holes 30 are arranged on each side wall, and are arranged such that the drain channel feeds into the drain holes, so that liquid in the container is drained through the drain holes. Intersecting lines on the bottom 6 indicate that the upper surface of the bottom 6 is tilted towards the sides, away from the middle of the bottom. This facilitates draining of liquid from the container.

Figure 19:
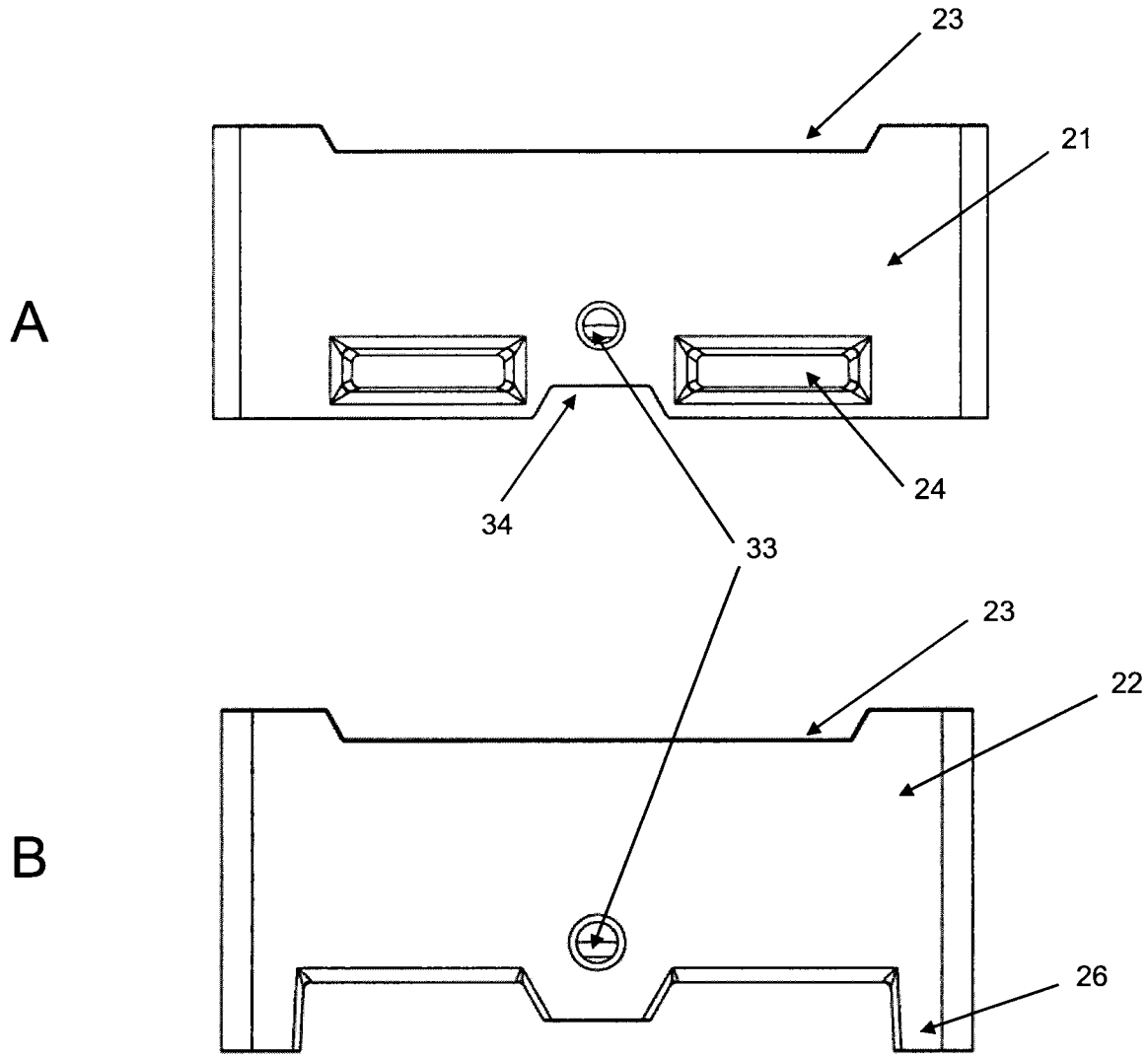
FIG. 19 shows side views (A) and (B) of an alternative embodiment of female containers in accordance with the invention.

Side views of an alternative female container are shown in FIG. 19. Here, drain holes 33 are shown, which serve the same purpose as on male containers. Further, the rim of the container has a single extended recess 23 arranged on both long side wall 21 (A) and short wall 22 (B).

Figure 20:
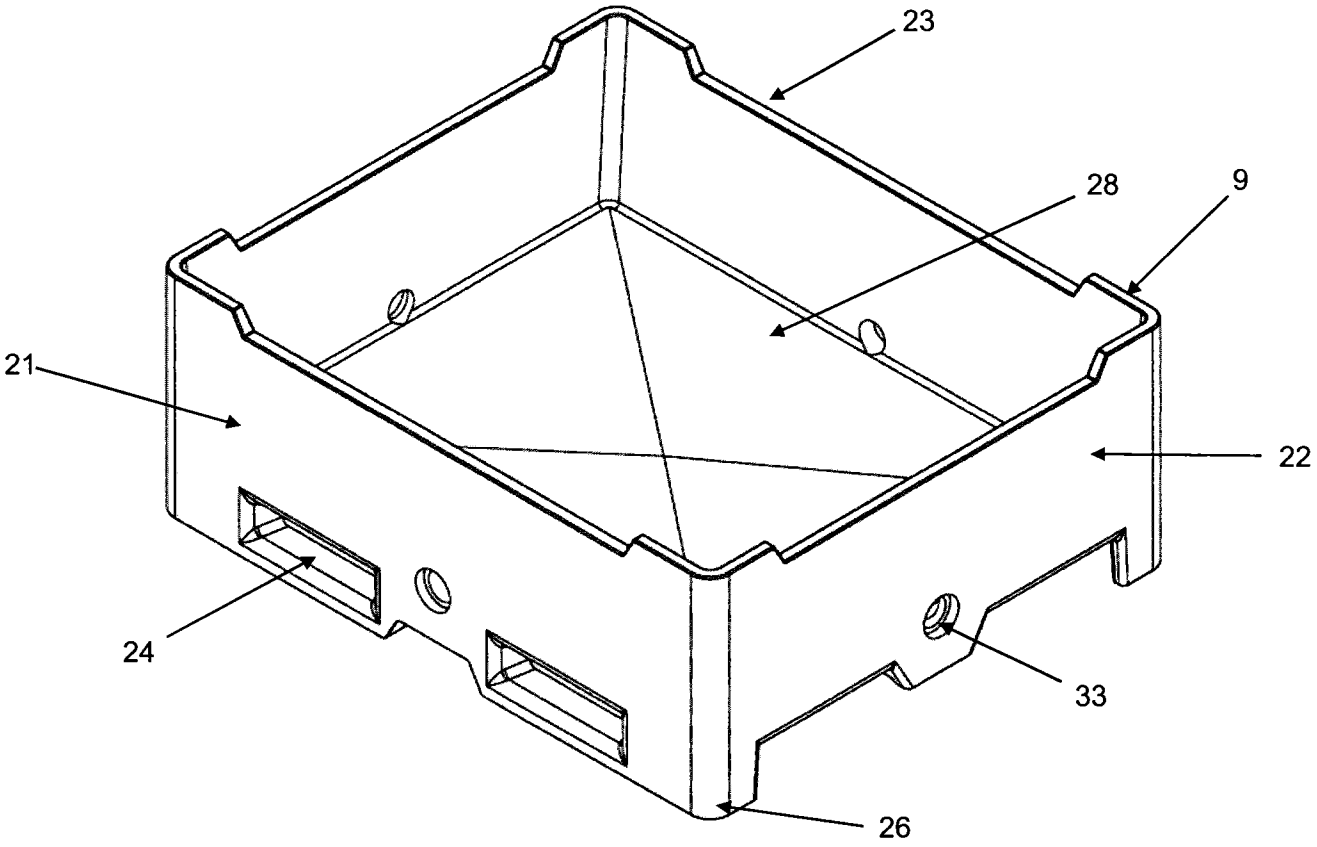
FIG. 20 shows a bird's eye view of a female container of an alternative embodiment of containers in accordance with the invention.
Figure 21B:
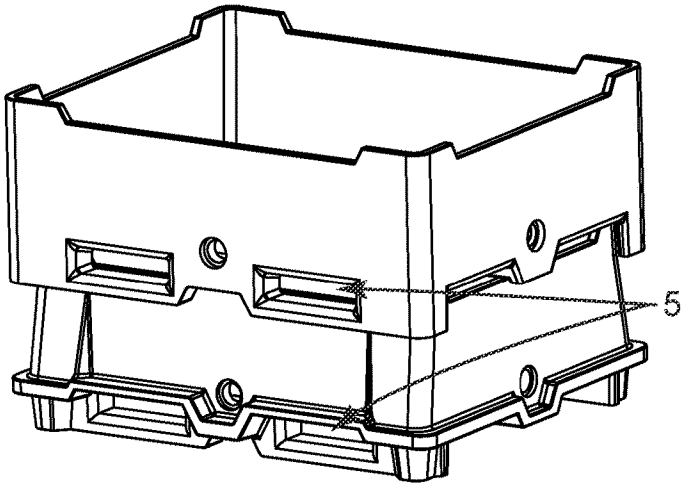
FIG. 21 shows stacking configurations of male and female containers as shown in FIGS. 17-20; (A) inverted male container stacked on top of an upright female container; (B) upright female container stacked on top of an upright male container; (C) upright male container stacked on top of an upright female container; (D) upright male container stacked on top of an inverted female container.
Figure 21D:
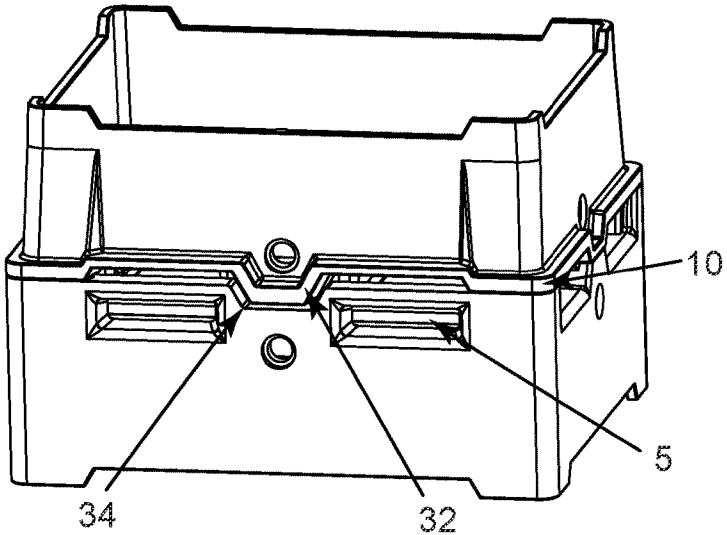
Figure 21A:
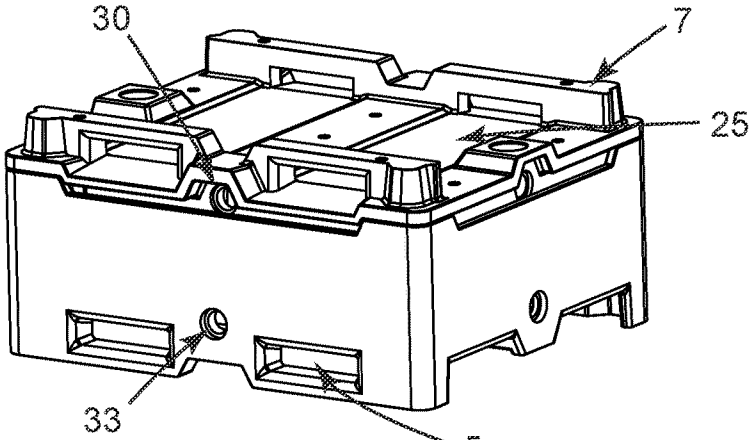
Figure 21C:
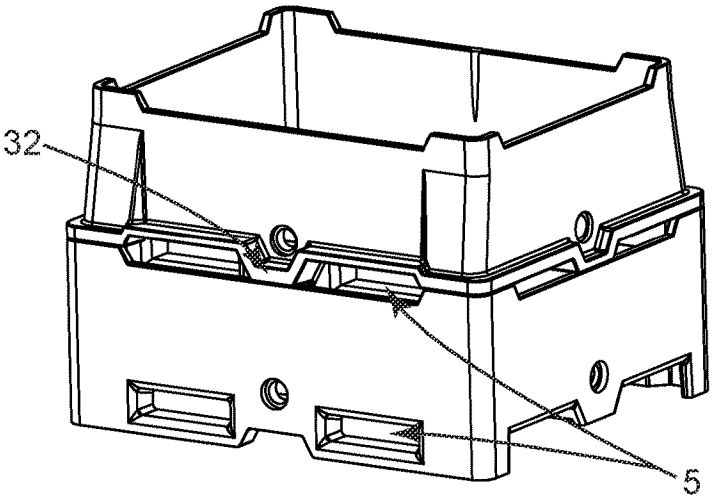

The view from above shown in FIG. 20 shows drain holes 33 and drain channel on the bottom of a female container, similar to that for the male container shown in FIG. 19. Also, similar to the male container, the bottom 28 is slanted, as indicated by the intersecting lines, away from the middle of the bottom, towards the sides, such that liquid in the container can be drained through the drain channel and drain holes 33.

Four views of stacking arrangements of the alternative male and female containers are shown in FIG. 21, wherein in (A) an inverted male container is stacked on top of an upright female container, in (B) an upright female container is shown stacked on top of an upright male container, in (C) an upright male container is stacked on top of an upright female container, and in (D) a upright male container is shown on top of an inverted female container. The inverted male container in (A) rests on the upper rim of the lower female container, the outer portion of the bottom of the container meeting the upper rim of the female container. The snug fit of the male container on top of the female container, supported by the inverted flanges, provides for a space-saving sandwich structure of containers, that can easily be transported by use of fork lift insertion openings on the lower female container. In the assemblies shown in (B) and (C), support members of female and male containers respectively form a stable sandwich structure, with respect to horizontal movement, by meeting adjacent upper side walls of adjacent containers, while the bottom of the containers rests on the upper rim of the lower container. The assembly in (D) shows how support members of adjacent containers, the lower being inverted, interconnect, so as to form a stable sandwich structure.

Figure 22A:
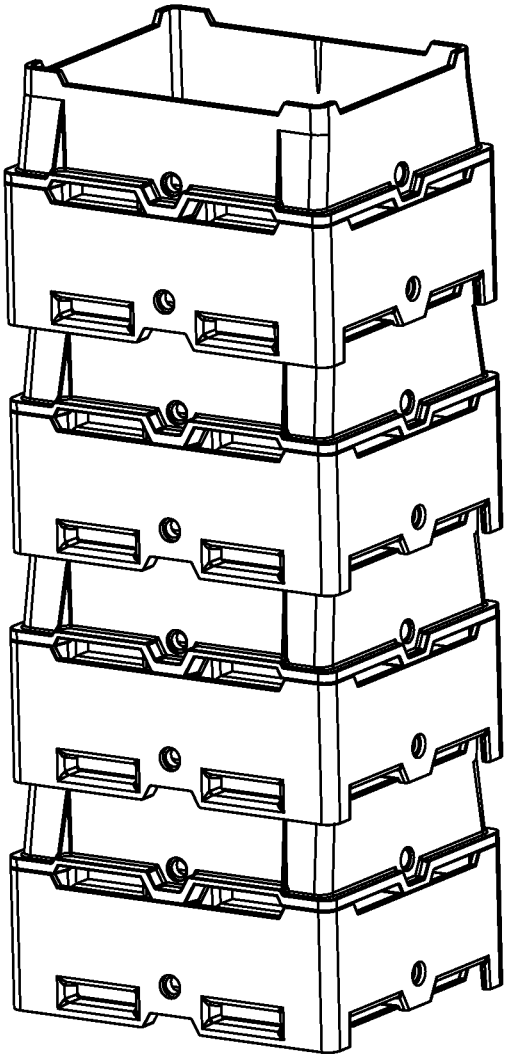
FIG. 22 shows stacks of alternative male and female containers, wherein in (A) there is shown a stack of upright male and female containers, in an alternative arrangement; and in (B) there is shown a stack of "sandwiches" of containers, wherein each sandwich contains an inverted male container that is stacked on top of an upright female container, and each sandwich being stacked on top of a lower sandwich, such that an upright female container fits snugly on top an adjacent inverted male container in the stack.
Figure 22B:
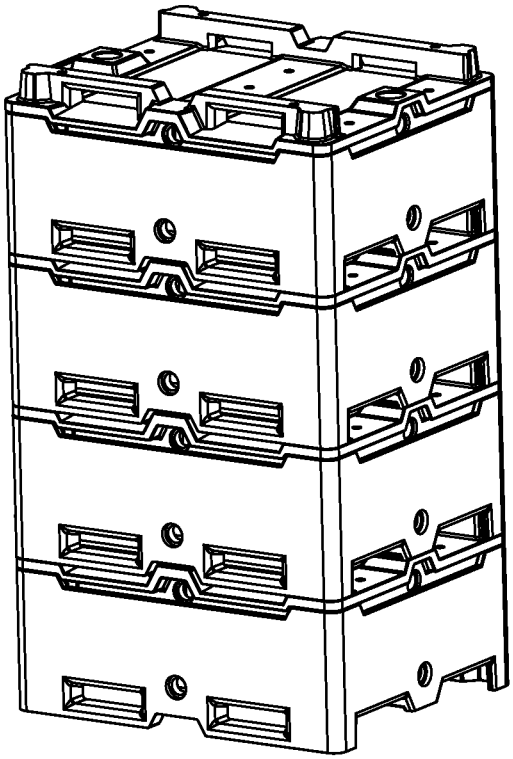

FIG. 22 shows a stack of containers comprising alternatively stacked male and female containers as shown above in FIGS. 17-21. On the left (A) a stack comprising alternating female and male containers, all upright, is shown. The stack is stable due to the close interaction and support provided by the structural configurations of the containers. On the right (B), a stack comprising the same number of containers is shown (8 in total), but wherein male containers are stacked in inverted position on top of upright female containers. The considerable space savings of the stack can be readily appreciated, by comparing with the stack in (A).

It is to be understood that the invention is not intended to be limited to the particular embodiments that are described in the foregoing. It is also to be understood that the terminology used herein is for the purpose of describing particular embodiments, and is not intended to be limiting in any way.

It should be noted that as used herein, the singular forms "a," "an," and "the" include plural references unless the context clearly dictates otherwise. Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges, and are also contemplated, subject to any specifically excluded limit in the stated range. Where the stated range includes one or both of the limits, ranges excluding either or both of those included limits are also contemplated.

It should be understood that the particular structural embodiments, methodology, materials, and substances, etc., described herein can vary. Thus, variations that are within the skills of the ordinary practitioner are also contemplated. The terminology used herein is for the purpose of describing particular embodiments only, and is not intended to limit the scope of the present invention.

Exemplary embodiments of the invention are described in the following clauses:

1. A male open top container, the container comprising a continuous structure that comprises:
   a substantially rectangular bottom having an upper surface, a lower surface and an outer edge of each side thereof, the bottom interconnecting four substantially upright side walls extending from the bottom, the side walls consisting of two pairs of oppositely located side walls extending from the bottom to form an opening having a rim around it, the lower end of the side walls being interconnected with the bottom at an inwardly position from the outer edge thereof, at least a portion of each of the side walls extending angularly inwardly from the bottom towards an opposing side wall, the container further comprising at least one support member extending downwardly from the lower surface of the bottom in proximity to the outer edge of the bottom.

2. The open top container of clause 1, wherein the angularly extending portion of the side walls is tilted with respect to a vertical axis by from about 1° to about 5°.
3. The open top container of clause 1 or clause 2, wherein the side walls extend angularly continuously inwardly with respect to the bottom.
4. The open top container of clauses, wherein the at least one support member is provided with at least two pairs of fork lift insertion openings, wherein each member of a pair of such fork lift insertion openings is arranged oppositely to a substantially identical fork lift insertion opening.
5. The open top container of clause 4, wherein the at least one support member is comprised of two oppositely located support members, each of the support members comprising fork lift insertion openings oppositely located to substantially identical openings on an oppositely located support member.
6. The open top container of clause 4, wherein the at least one support member is comprised of two pairs of oppositely located support members that are arranged close to two opposite outer edges of the bottom, such that each support member that is arranged close to a first outer edge of the bottom is oppositely located to a substantially identical support member that is arranged close to a second outer edge of the bottom.
7. The open top container of clause 1, comprising at least three support members located in close proximity to the outer edge of one side of the bottom, and at least three oppositely located support members in close proximity to an opposite outer edge of the bottom, wherein the at least three support members are configured to provide at least two fork lift openings thereinbetween.
8. The open top container of clauses, wherein the rim has at least one recess along each side of the container.
9. The open top container of clauses, wherein the rim has a plurality of oppositely positioned recesses.
10. The open top container of the previous clause, wherein at least two of the recesses being at least of substantially equal length as, and being substantially vertically aligned with, the fork lift openings.
11. The open top container of clause 4, wherein the at least one support member is provided as a continuous structure in proximity of the outer edge of the bottom.
12. The open top container of clauses, wherein at least two oppositely located side walls each further comprise at least one flange extending upwardly from a lower edge, the flange being upwardly tapered along at least a portion of the side wall.
13. The open top container of clause 9, wherein the at least one flange is configured such that the flange extends from an upper surface of the bottom, and wherein at its lower edge, the horizontal distance from the outer edge of the bottom to the flange is approximately equal to the width of the rim of the side walls.
14. The open top container of clause 9 or clause 10, wherein the at least one flange extends upwardly from the bottom along the side walls.
15. The open top container of any one of the clauses 9 to 11, wherein the thickness of the at least one flange along its upper edge is substantially smaller than its thickness along its lower edge.
16. The open top container of any one of clauses 9 to 12, wherein the flange is tapered along substantially its entire length.
17. The open top container of clauses, wherein the upper surface of the bottom is at least partially slanted, so that when placed on a level surface, liquid in the container will flow towards at least one side of the container.
18. The open top container of the previous clause, wherein the upper surface of the bottom is slanted from its middle towards the sides of the container, so that when placed on a level surface, liquid in the container will flow towards the sides of the container.
19. The open top container of clauses, wherein the container further comprises at least one drain, for draining liquid from the container.
20. The open top container of clauses, wherein the container has at least one drain hole arranged on at least one side wall, the drain hole traversing the side wall and being provided as an opening onto the bottom surface of the container, to allows liquid within the container to flow through the drain hole.
21. The open top container of the previous clause, wherein the container has a drain hole arranged on each side wall.
22. The open top container of clauses, the container further comprising at least one drain channel for collecting and/or dispersing liquid within the container.
23. The open top container of the previous clause, wherein the drain channel is fluidly connected to at least one drain hole in the container, so that liquid within the container can be released through the drain channel and the drain hole.
24. The open top container of any of the previous two clauses, wherein the drain channel is arranged on the upper surface of the bottom, at a meeting point of the bottom and the side walls.
25. A female open top container comprising a continuous structure comprising:

a substantially rectangular bottom having an upper surface, a lower surface and an outer edge of each side thereof, the bottom interconnecting four substantially vertical side walls extending from the bottom, the side walls consisting of two pairs of oppositely located side walls extending from the bottom to form an opening having a rim around it, the container further comprising at least one support member extending downwardly from the lower surface of the bottom in proximity to the outer edge of the bottom, wherein the at least one support member provides at least two oppositely oriented fork lift insertion openings along opposite sides of the container, and wherein the container further comprises at least one drain, for draining liquid from the container.

26. The open top container of clause 25, wherein the at least one support member is provided as two oppositely located support members, and wherein the at least two fork lift insertion openings are oppositely located to substantially identical openings on an oppositely located support member.

27. The open top container of any one of the clauses 25 or 26, wherein the at least one support member is provided as a single support member structure, the structure extending along, and downwardly from, the outer edge of the bottom.
28. The open top container of any one of the clauses 25 to 27, wherein the at least one support member extends downwardly from the outer edge of the bottom, so as to form a continuous planar surface with the outer edge of the bottom and at least two of the side walls.
29. The open top container of clauses 25 to 28, wherein the rim has a plurality of recesses.
30. The open top container of clauses 25 to 29, wherein the rim comprises continuous recesses along at least two opposite sides of the container that also have support members arranged close thereto, and wherein each of such recesses is vertically aligned with the thus arranged support members.
31. The open top container of any one of the clauses 25 to 30, wherein the recesses are of a height that is at least one quarter of the height of the fork lift openings.
32. The open top container of any one of the clauses 25 to 31, wherein the recesses are of a height that ranges from about one quarter to about three quarters of the height of the fork lift openings.
33. The open top container of any one of the clauses 25 to 32, wherein the upper surface of the bottom is at least partially slanted, so that when placed on a level surface, liquid in the container will flow towards at least one side of the container.
34. The open top container of the previous clause, wherein the upper surface of the bottom is slanted from its middle towards the sides of the container, so that when placed on a level surface, liquid in the container will flow towards the sides of the container.
35. The open top container of any one of the clauses 25 to 34, wherein the container further comprises at least one drain, for draining liquid from the container.
36. The open top container of clauses 25 to 35, wherein the container has at least one drain hole arranged on at least one side wall, the drain hole traversing the side wall and being provided as an opening onto the bottom surface of the container, to allow liquid within the container to flow through the drain hole.
37. The open top container of clauses 35 or 36, wherein the container has a drain hole arranged on each side wall.
38. The open top container of clauses 25 to 37, the container further comprising at least one drain channel for collecting liquid within, and/or draining liquid from, the container.
39. The open top container of the previous clause, wherein the drain channel is fluidly connected to at least one drain hole in the container, so that liquid within the container can be released through the drain channel and the drain hole.
40. The open top container of any of the previous two clauses, wherein the drain channel is arranged on the upper surface of the bottom, at a meeting point of the bottom and the side walls.
41. A system of containers, the system comprising alternately vertically stackable open-topped male and female containers, each male container and each female container comprising
    a body comprising a bottom having an upper surface, a lower surface and an outer edge, the bottom interconnecting four substantially upright side walls extending from the bottom, the side walls consisting of two pairs of oppositely placed side walls extending from the bottom to form an opening having a rim, wherein the bottom of male and female containers are of substantially equal length and width, the side walls of the female container extending substantially vertically from the bottom, the side walls of the male container extending angularly inwardly towards an opposing side wall from an inwardly position of the bottom with respect to its outer edge, such that when turned by 180° from an upright position, the walls of the male container will fit within the opening of an upright female container.
42. The system of containers according to the previous clause,
    each male member further comprising at least one support member extending downwardly from the lower surface of the bottom in proximity to the outer edge of the bottom, the at least one support member being shaped such that
    when a male container is stacked in an upright orientation on top of an upright female container, the at least one support member of the male container fits within the rim of the female container such that a peripheral portion of the bottom of the male container meets at least a portion of the rim of the female member.
43. The system of clause 41 or 42, wherein the male and female containers are further shaped so that
    when a female container is stacked in an upright orientation on top of an upright male container, the at least one support member of the female container allows the rim of the male container to meet the lower surface of the bottom of the female container at an inwardly position from the edge of the bottom of the female container.
44. The system of any one of the clauses 41 to 43, wherein the at least one support member of the male and female containers are further configured so as to be in close proximity to an upper portion of opposing side walls of an adjacent container in a vertical stack of containers that are in an upright position, so as maintain the stack in a stable state.
45. The system of any one of the clauses 41 to 44, wherein the side wall of the male member is further configured such that when a female member is stacked on top of a male member in an inverted orientation, the rim of the female member meets a substantial portion of the outer edge of the bottom of the male member in close proximity to the lower portion of the side wall of the male container, so as to maintain the stack in a stable state.
46. The system of any one of the clauses 41 to 45, wherein the support members of the male and female containers are further configured so as to be engaged in a locked position with support members of an adjacent member within the stack with respect to horizontal movement when a male container is stacked in an upright position on top of an inverted female container.
47. The system of any one of the clauses 41 to 46, wherein the support member of the male container is structured such that when a male container is stacked on top of an upright female container, the support member of the male container will fit within the rim of the lower female container, and wherein at least two recesses are provided on the rim of the female container and aligned with fork lift insertion openings of the support member of the male container, to allow a fork lift to lift the male container.

48. The system of any one of the clauses 41 to 47, wherein the support member of the male container is further structured so that when a male container is stacked on top of an inverted female container, the support member of the male container will fit snugly with the at least one support member of the female container, thus keeping the male and female containers in a locked position with respect to horizontal movement.

49. The system of any one of clauses 42 to 48, wherein the at least one support member is provided with fork lift insertion openings parallel to, and in close proximity with, the outer edge of the bottom, oppositely positioned with respect to identical fork lift insertion openings parallel to, and in close proximity with, an opposing outer edge of the bottom.

50. The system of any one of clauses 42 to 49, wherein the at least one support member is comprised of two oppositely located support members, each of the support members comprising fork lift insertion openings oppositely located to substantially identical openings on an oppositely located support member.

51. The system of any one of clauses 42 to 50, comprising at least three support members located in close proximity to the edge of one side of the bottom, and at least three oppositely located support members in close proximity to an opposite edge of the bottom, wherein the at least three support members are configured to provide at least two fork lift openings thereinbetween.

52. The system of any one of the clauses 41 to 51, wherein the male container comprises at least two pairs of fork lift insertion openings, wherein each member of a pair of such fork lift insertion openings is arranged oppositely to a substantially identical fork lift insertion opening.

53. The system of any one of the clauses 42 to 50, wherein the at least one support member on the male container is comprised of two oppositely located support members, each of the support members comprising fork lift insertion openings oppositely located to substantially identical openings on an oppositely located support member.

54. The system of any one of the clauses 42 to 50, wherein the at least one support member on the male container is comprised of two pairs of oppositely located support members that are arranged close to two opposite outer edges of the bottom of the male container, such that each support member that is arranged close to a first outer edge of the bottom is oppositely located to a substantially identical support member that is arranged close to a second outer edge of the bottom.

55. The system of any one of clauses 41 to 54, wherein the angularly extending portion of the side walls of the male container is tilted with respect to a vertical axis by from about 1° to about 5°.

56. The system of any one of clauses 41 to 55, wherein the side walls of the male container extend angularly continuously inwardly with respect to the bottom.

57. The system of any one of clauses 41 to 56, wherein the rim of the male and/or female container has a plurality of recesses, the recesses being vertically aligned with, and at least of equal length as, the fork lift insertion openings.

58. The open top container of clauses 41 to 56, wherein the rim of the male and/or female container comprises continuous recesses along at least two opposite sides of the container that also have support members arranged close thereto, and wherein each of such recesses is vertically aligned with the thus arranged support members.

59. The system of clause 57 or clause 58, wherein the recesses are of a height that is at least one quarter of the height of the fork lift openings.

60. The system of clause 59, wherein the recesses are of a height that ranges from about one quarter to about three quarters of the height of the fork lift openings.

61. The system of any one of clauses 41 to 60, wherein at least two oppositely located side walls of the male container each further comprise at least one flange extending upwardly from a lower edge, the flange being upwardly tapered along at least a portion thereof 62. The system of clause 61, wherein the at least one flange is configured such that at its lower edge, the horizontal distance from the outer edge of the bottom to the flange is approximately equal to the width of the rim of the side walls of the female container.

63. The system of clause 61 or clause 62, wherein the at least one flange extends upwardly from the bottom along the side walls.

64. The system of any one of the clauses 61 to 63, wherein the thickness of the at least one flange along its upper edge is substantially smaller than its thickness along its lower edge.

65. The system of any one of clauses 61 to 64, wherein the flange is tapered along substantially its entire length.

66. The system of any one of the clauses 41 to 65, wherein the at least one support member of the female container is provided as two oppositely located support members, and wherein the at least two fork lift insertion openings of the female container are oppositely located to substantially identical openings on an oppositely located support member.

67. The system of any one of the clauses 41 to 66, wherein the at least one support member of the female container is provided as a single support member structure, the structure extending along, and downwardly from, the outer edge of the bottom of the female container.

68. The system of any one of the clauses 41 to 67, wherein the at least one support member of the female container extends downwardly from the outer edge of the bottom of the female container, so as to form a continuous planar surface with the outer edge and at least two of the walls of the female container.

69. A system of containers, comprising alternately vertically stackable open-topped male and female containers, each male container and each female container comprising a body comprising a bottom having an upper surface, a lower surface and an outer edge, the bottom interconnecting four substantially upright side walls extending from the bottom, the side walls consisting of two pairs of oppositely placed side walls extending from the bottom to form an opening having a rim, wherein the bottom of male and female containers are of substantially equal length and width, the side walls of the female container extending substantially vertically from the bottom, the side walls of the male container extending angularly inwardly towards an opposing side wall from an inwardly position of the bottom with respect to its outer edge, such that when turned by 180° from an upright position, the walls of the male container will fit within the opening of an upright female container;

each male member and each female member further comprising at least one support member extending downwardly from the lower surface of the bottom in proximity to the outer edge of the bottom, the at least one support member being shaped such that when a male container is stacked in an upright orientation on top of an upright female container, the support member of the male container fits within and rests on recesses along the rim of the female container, when female container is stacked in an upright orientation on top of a male container, the support member of the female container allows the rim of the male container to meet the lower surface of the bottom of the female container at an inwardly position from the edge of the bottom of the female container, the at least one support member of the male and female containers being configured so as to be in close proximity to an upper portion of opposing side walls of an adjacent container in a vertical stack of containers that are in an upright position, so as maintain the stack in a stable state;

wherein the side wall of the male member is further configured such that when a female member is stacked on top of a male member in an inverted orientation, the rim of the female member meets a substantial portion of the outer edge of the bottom of the male member in close proximity to the lower portion of the male side wall, so as to maintain the stack in a stable state; and wherein the support members of the male and female containers are further configured so as to be engaged in a locked position with support members of an adjacent member within the stack with respect to horizontal movement when a male container is stacked in an upright position on top of an inverted female container.

The invention claimed is:

1. A system of containers, the system comprising:

at least two alternately vertically stackable open-topped male and female containers that each comprise a single continuous structural unit, so that within a stack a male container meets a female container and vice versa, each male container comprising:

a substantially rectangular bottom having an upper surface, a lower surface and an outer edge of each side thereof two pairs of oppositely located side walls extending from the bottom, each side wall having a rim disposed at an upper end of each side wall, the rims of the side walls being interconnected to form an opening, the lower end of the side walls being interconnected with the bottom at an inwardly position from the outer edge thereof, at least a portion of the outer surface of each of the side walls of the male container extending angularly inwardly from the bottom towards an opposing side wall such that a distance between rims of each pair of oppositely located side walls is smaller than a distance between the lower ends of each pair of oppositely located side walls, and each female container comprising a substantially rectangular bottom having an upper surface, a lower surface and an outer edge of each side thereof, two pairs of oppositely located side walls extending substantially vertically from the bottom, each side wall having a rim disposed at an upper end of each side wall to form an opening, and wherein, when the female container is turned by 180° from an upright position, the walls of the male container will fit within the opening of the female container.

2. The system of containers according to claim 1, each male container further comprising at least one support member extending downwardly from the lower surface of the bottom in proximity to the outer edge of the bottom, the at least one support member being shaped such that when a male container is stacked in an upright orientation on top of an upright female container, the at least one support member of the male container fits within the rim of the female container such that a peripheral portion of the bottom of the male container meets at least a portion of the rim of the female member.

3. The system of claim 1, wherein the female containers comprise at least one support member, and wherein the male and female containers are further shaped so that when a female container is stacked in an upright orientation on top of an upright male container, the at least one support member of the female container allows the rim of the male container to meet the lower surface of the bottom of the female container at an inwardly position from the edge of the bottom of the female container.

4. The system of claim 1, wherein the male and female containers further comprise at least one support member that is configured so as to be in close proximity to an upper portion of opposing side walls of an adjacent container in a vertical stack of containers that are in an upright position, so as maintain the stack in a stable state.

5. The system of claim 1, wherein the side wall of the male member is further configured such that when a female member is stacked on top of a male member in an inverted orientation, the rim of the female member meets a substantial portion of the outer edge of the bottom of the male member in close proximity to the lower portion of the side wall of the male container, so as to maintain the stack in a stable state.

6. The system of claim 1, wherein the male and female containers further comprise at least one support member that is configured as to be engaged in a locked position with support members of an adjacent member within the stack with respect to horizontal movement when a male container is stacked in an upright position on top of an inverted female container.

7. The system of claim 1, wherein the male container comprises at least one support member that is structured such that when a male container is stacked on top of an upright female container, the support member of the male container will fit within the rim of the lower female container, and wherein at least two recesses are provided on the rim of the female container and aligned with fork lift insertion openings of the support member of the male container, to allow a fork lift to lift the male container.

8. The system of claim 1, wherein each of the male and female containers further comprises at least one support member that is structured so that when a male container is stacked on top of an inverted female container, the support member of the male container will fit snugly with the at least one support member of the female container, thus keeping the male and female containers in a locked position with respect to horizontal movement.

9. The system of claim 1, wherein the male and female containers comprise at least one support member that is provided with fork lift insertion openings parallel to, and in close proximity with, the outer edge of the bottom, oppositely positioned with respect to identical fork lift insertion openings parallel to, and in close proximity with, an opposing outer edge of the bottom.

10. The system of claim 1, wherein the rim of the male and/or female container has a plurality of recesses, the recesses being vertically aligned with, and at least of equal length as, the fork lift insertion openings.

11. The system of containers of claim 1, wherein each male container comprises:

a pair of oppositely located recesses that are provided on the rims of a pair of oppositely located side walls, each recess having a bottom surface and two side surfaces extending upwardly from the bottom surface to form an upper opening of the recess, the bottom and side surfaces of the recess forming a portion of the rim of each of the pair of oppositely located side walls, and wherein a distance between the bottom surfaces of the pair of oppositely located recesses is smaller than a distance between the lower ends of the pair of oppositely located side walls.

12. The system of containers of claim 1, wherein on each male container at least two oppositely located side walls each further comprise at least one flange extending upwardly from a lower edge, the flange being upwardly tapered along at least a portion of the side wall.

13. The system of containers of claim 1, wherein each container comprises at least one drain, for draining liquid from the container.

14. The system of containers of claim 1, wherein each male container comprises at least one drain channel for collecting and/or dispersing liquid within the container, wherein the drain channel is fluidly connected to at least one drain hole in the container, so that liquid within the container can be released through the drain channel and the drain hole.

15. The system of containers of claim 1, wherein each female container has at least one drain hole arranged on at least one side wall, the drain hole traversing the side wall and being provided as an opening onto the bottom surface of the container, to allow liquid within the container to flow through the drain hole.

16. The system of containers of claim 1, wherein each female container has at least one drain channel for collecting and/or dispersing liquid within the container, wherein the drain channel is fluidly connected to at least one drain hole in the container, so that liquid within the container can be released through the drain channel and the drain hole.

* * * * *